United States Patent [19]

Taube et al.

[11] Patent Number: 4,722,215

[45] **Date of Patent: * Feb. 2, 1988**

[54] METHOD OF FORMING A ONE-PIECE CAN BODY HAVING AN END REINFORCING RADIUS AND/OR STACKING BEAD

[75] Inventors: William L. Taube, Murrietta, Calif.; David A. Roberts, Wokingham, England

[73] Assignee: Metal Box, plc, United Kingdom

[ * ] Notice: The portion of the term of this patent subsequent to Feb. 25, 2003 has been disclaimed.

[21] Appl. No.: 832,417

[22] Filed: Feb. 24, 1986

Related U.S. Application Data

[63] Continuation-in-part of Ser. No. 579,977, Feb. 14, 1984, Pat. No. 4,571,978.

[51] Int. Cl.[4] ..... B21D 22/00; B21D 51/26

[52] U.S. Cl. ..... 72/349; 72/354; 413/76

[58] Field of Search ..... 72/347, 348, 349, 350, 72/351, 354, 356, 361; 220/66, 70; 413/8, 56, 73, 76

[56] References Cited

U.S. PATENT DOCUMENTS

| | | | |
|---|---|---|---|
| 2,763,228 | 9/1956 | Lawson | 72/348 X |
| 3,307,388 | 3/1967 | Brooks et al. | 72/348 |
| 3,537,291 | 11/1970 | Hawkins | 72/336 |
| 3,957,005 | 5/1976 | Heffner | 72/348 X |
| 3,973,693 | 8/1976 | Brockelhurst | 220/66 |
| 4,031,837 | 6/1977 | Jordan | 413/8 |
| 4,037,752 | 7/1977 | Dulmaine et al. | 220/70 |
| 4,109,599 | 8/1978 | Schultz | 413/8 |
| 4,121,448 | 10/1978 | Censuales | 72/348 |
| 4,431,112 | 2/1984 | Yamaguchi | 220/70 |
| 4,571,978 | 2/1986 | Taube et al. | 72/349 |

FOREIGN PATENT DOCUMENTS

| | | | |
|---|---|---|---|
| 2398669 | 3/1979 | France | 220/70 |

*Primary Examiner*—E. Michael Combs

*Attorney, Agent, or Firm*—Diller, Ramik & Wight

[57] ABSTRACT

The invention herein relates to a method of forming a one-piece can body having a reinforced pressure-resistant can end and/or stacking bead by first forming a generally cup-shaped blank defined by a generally cylindrical body, a radius portion and an end, exerting first forces against the cup-shaped blank in a first direction to form the end into a concavely outwardly opening end defined by a central end panel, a frusto-conical wall and an annular inwardly opening channel merging with the cylindrical body, and exerting second forces against the annular channel in a second direction opposite the first direction while gripping the central end panel to reform either or both the frusto-conical wall and a part of the annular channel to selectively form one or both of an inwardly projecting outwardly opening annular bead and an outwardly projecting inwardly opening annular bead defining respective reinforcing and stacking beads, and the first and second directions defining a single reciprocal opposing path of force exertion by the first and second forces.

18 Claims, 41 Drawing Figures

METHOD OF FORMING A ONE-PIECE CAN BODY HAVING AN END REINFORCING RADIUS AND/OR STACKING BEAD

This application is a continuation-in-part of application Ser. No. 06/579,977, filed Feb. 14, 1984 and now U.S. Pat. No. 4,571,978 patented on 2/25/86.

BACKGROUND OF THE INVENTION

The present invention is directed to a method of and apparatus for forming a can end which is highly resistant to internal pressure when seamed to a product-containing can.

Typical of one conventional method of manufacturing so-called pressure resistant can ends is that disclosed in U.S. Pat. No. 4,109,599 in the name of Freddy R. Schultz issued Aug. 29, 1978 and assigned to Aluminum Company of America. In accordance with one method disclosed in this patent, a sheet metal blank is positioned between a pair of dies which are moved to first shear an edge of the blank after which a punch descends to form the now circular blank about an annular ring into an end shell having a peripheral flange, a frusto-conical wall, a radius and an end panel. The end shell is then removed from the first set of dies and inserted into a second set of dies in which the peripheral flange is curled into a downward peripheral flange suitable for double seaming operations.

The end shell is than placed between another pair of dies which when moved toward each other form the radius into a reinforcing channel or annular groove adjoining the simultaneously formed domed central panel. The so-called reinforcing channel or annular groove increases the pressure resistance of the can end because of the reinforcement created by the increased depth of the annular groove with respect to the central panel and the tight radius of curvature of the latter. This type of reinforcement is said to make it possible to reduce the gauge thickness of a can end about 10 to 20 percent while maintaining pressure resistance capabilities of a conventional can end. However, the patent also acknowledges two dichotomous principles which are at work in the manufacture of a pressure resistance can end of this type, namely, the deepening of the annular groove and the tightening of its radius acts to increase pressure resistance, but the drawing operation has the effect of thinning the metal which acts to decrease pressure resistance.

While the objectives of conventional methods and apparatus are acknowledged herein, it is also important to recognize that such known methods also include other disadvantages, particularly when a blank or end shell must be transferred between a first set of dies to a second set of dies which virtually necessarily create alignment and/or tolerance problems, not to mention the simple fact that the transfer itself adds time to an overall forming operation simply because of the time involved in the transfer per se. Furthermore, it is not uncommon to lacquer the blanks prior to any forming operation, and forming in different dies and/or transferring between dies increases the tendency of the lacquer or enamel to crack or otherwise expose the metal to the eventual product packaged within a can to which the end has been seamed. The latter can result in undesired product deterioration.

Another disadvantage of forming a pressure-resistant can end in a series of different dies between which the blank must be transferred is simply the inability to maintain acceptable tolerances, particularly relative to overall concentricity, flange height and hook length. These three factors collectively establish to a large measure the eventual uniformity of successful double seaming which, once again, can be critical to product shelf life and/or longevity.

SUMMARY OF THE INVENTION

In keeping with the foregoing, it is a primary object of this invention to provide a novel method of an apparatus for forming a reinforced pressure resistant can end within a single set of dies and in the absence of any type of transfer or movement of the metallic blank once a forming operation has begun by utilizing the single set of dies to selectively localize an increased thickness of metal at a juncture at an outer frustoconical peripheral wall and a reinforcing countersink radius of the can end, while at the same time localizing a thinner flexible wall portion between a panel radius and a circular central panel of the can end to thereby provide increased reinforcement in the absence of metal exposure, flexibility to transfer or absorb forces, and optimum tolerance including flange height, hook length and concentricity.

A further object of this invention is to provide a novel apparatus and method as latter defined including a draw punch and a reform pad carried by a first support movable relative to an indent ring and a lift ring carried by a second support, means for fluidically, penumatically and/or spring clamping a central panel of a metallic blank between the reform pad and the indent ring, the draw punch being part of the first force exerting means for exerting first forces against a peripheral edge portion of the blank in a first direction to deform the peripheral edge portion out of the plane of the central panel and shape the blank into a generally flanged cup-shaped configuration defined by the centrla panel, a radius, a frusto-conical wall and an annular flange, and the lift ring defining part of second force exerting means for exerting second forces greater than the first forces against the flange in a second direction opposite the first direction while the center panel is still gripped between the reform pad and the indent ring to deform a part of the metal of the radius in the absence of constraint out of the plane of the central panel and to a side thereof opposite the annular flange to thereby form the reinforcing countersink radius of localized increased thickness as set forth in the previous object.

Still another object of this invention is to provide a novel apparatus as set forth immediately above wherein at least one of the reform pad and the draw punch form an annular chamber into which is formed the radius part during the operation of the second force exerting means to form the reinforcing countersink radius.

A further object of this invention is to provide a novel apparatus as aforesaid wherein the draw punch includes an inner frusto-conical surface in generally opposed relationship to an annular angled surface of the reform pad between the peripheral surface and a terminal end face of the latter which individually or collectively form an annular chamber into which is formed the radius part during the operation of the second force exerting means to form the reinforcing countersink radius.

A further object of this invention is to provide a novel apparatus as heretofore described wherein the indent ring includes a peripheral surface and an axial end face, and means in the form of an annular outwardly opening groove between the peripheral surface and the terminal end face of the indent ring for effecting unrestrained stretching of the material forming the first-mentioned radius during the movement of the draw punch in the first direction.

Another object of the invention is to provide a novel apparatus as aforesaid including respective convex and concave terminal end faces of the draw punch and lift ring for guiding metal therethrough during the movement of the draw punch in the first direction.

Still another object of this invention is to provide a novel apparatus as heretofore described wherein the force exerting means for moving the reform pad and the draw punch is a source of fluidic pressure, and the force of the latter is utilized during movement of the draw punch in the first direction to load a mechanical spring which in turn applies the force in the second direction through the lift ring upon return movement of the draw punch opposite its first direction of travel.

A further object of this invention is to provide a novel method of forming a one-piece drawn and/or wall-iron can having a reinforced can bottom or end by forming a generally cup-shaped blank from a flat metallic blank by means of a conventional punch and die, the cup-shaped blank being defined by a generally cylindrical body, a radius portion and an end, exerting first forces against the cup-shaped blank in a first direction to form the end into a concavely outwardly opening end defined by a central end panel, a frusto-conical wall and an annular inwardly opening channel merging with the cylindrical body, exerting second forces against the annular channel in a second direction opposite the first direction while gripping the central end panel to reform a part of the frusto-conical wall in the absence of restraint out of the plane of the central end panel toward the interior of the can to form an inwardly projecting outwardly opening annular bead, and the first and second directions defining a single reciprocal opposing path of force exertion by the first and second forces.

Still another object of this invention is to provide a novel method of forming a can having a reinforced can body as aforesaid, except as in this case the second forces while exerted against the annular channel in the second direction opposite to the first direction reform a part of the annular channel, not the frusto-conical wall, and do so while the annular wall is under at least partial restraint to reform a part of the annular channel out of the plane thereof toward the exterior of the can to form an outwardly projecting inwardly opening annular bead.

Yet another object of this invention is to form a novel can as aforesaid and in either or both of these so-formed inwardly and/or outwardly projecting annular beads which respectively define reinforcing and stacking beads of the associated can.

With the above and other objects in view that will hereinafter appear, the nature of the invention will be more clearly understood by reference to the following detailed description, the appended claims and the several views illustrated in the accompanying drawings:

DESCRIPTION OF THE PREFERRED EMBODIMENTS

Figure 1:
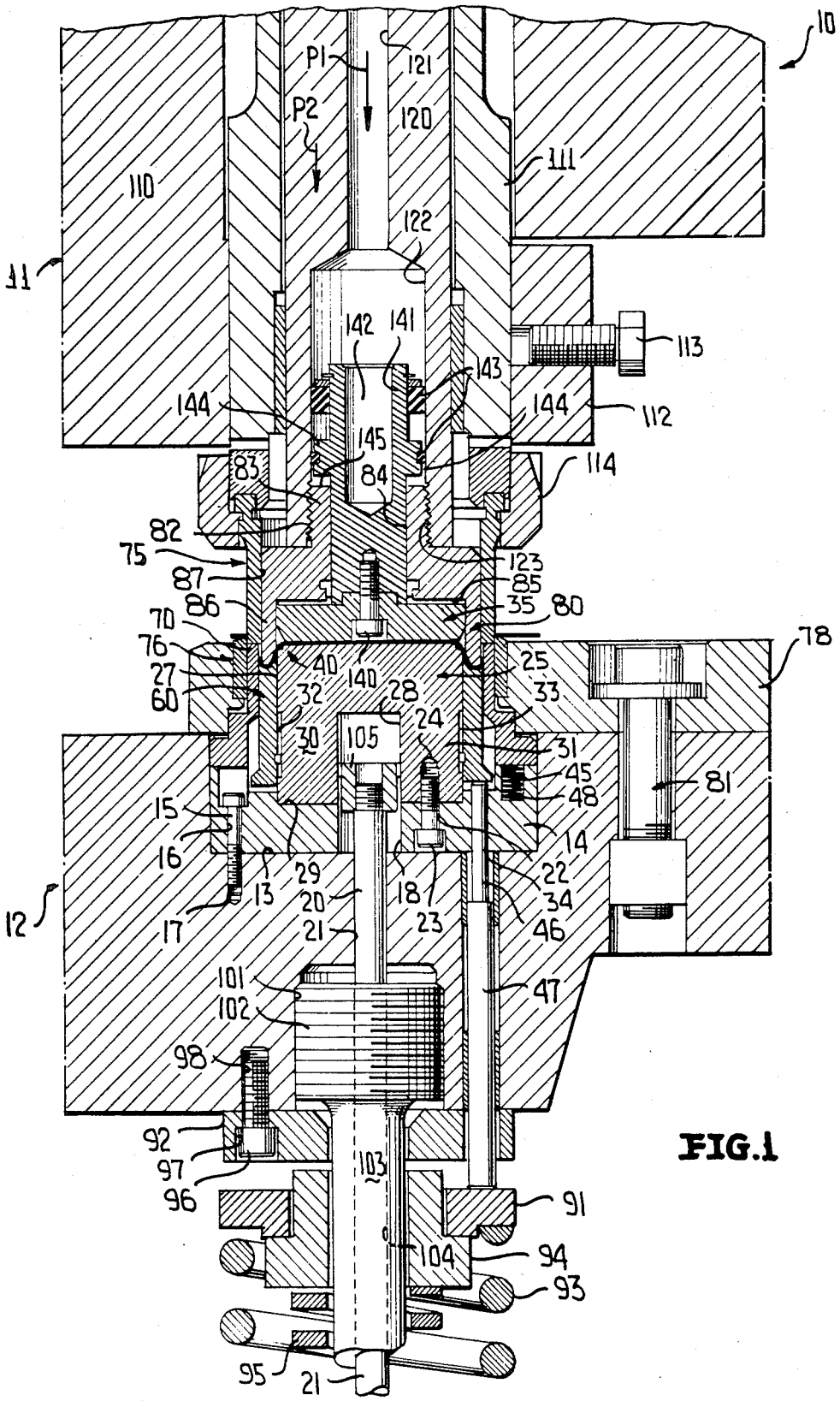
FIG. 1 is a generally axial sectional view with some parts shown in elevation of a press including a punch and die, and illustrates as part of the punch a fluidically (preferably pneumatically) operated reform pad, and as part of the die an indent ring and a mechanically operated lift ring with the tooling shown at the completion of the first or forming operation in which a blank is formed to a generally cup-like configuration defined by a circular center panel, a radius, a frusto-conical wall and an annular flange.
Figure 11:
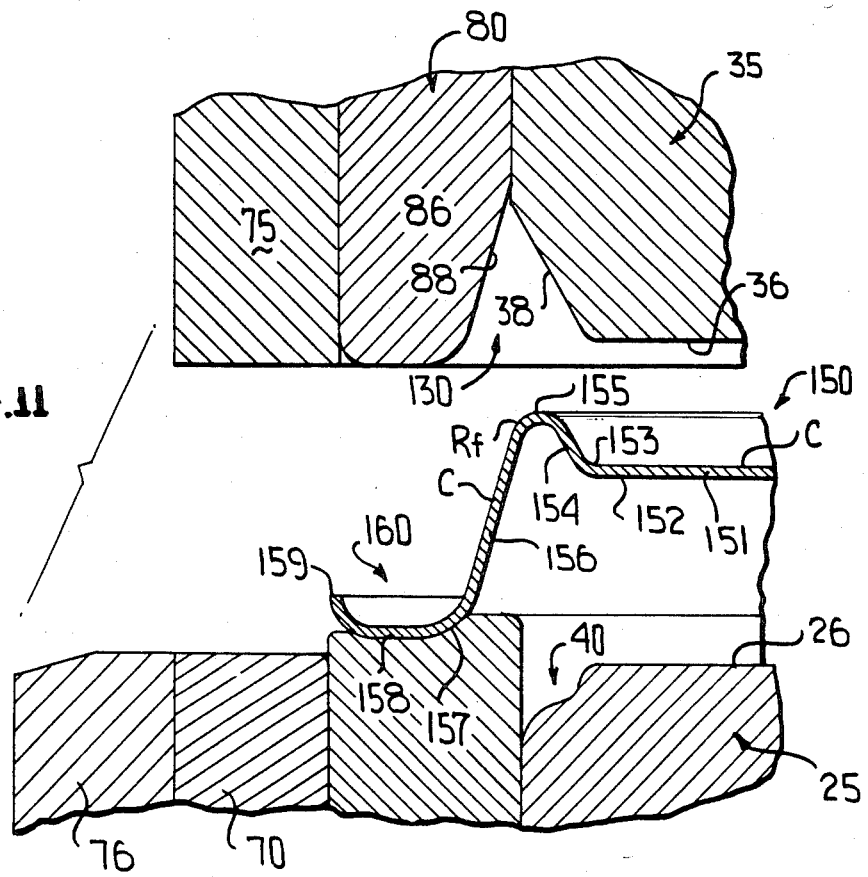
FIG. 11 is an enlarged fragmentary schematic cross-sectional view of the tooling of FIG. 10, and illustrates the punch and die fully opened and the lift ring at a position permitting ejection of the completed can end.

The invention will be best understood by first referring to FIG. 1 of the drawings which illustrates a portion of a conventional multi-die double action press which is generally designated by the reference numeral 10. The press 10 includes a punch 11 and a die or bolster block assembly 12. The bolster block assembly 12 is a stationary portion of the frame (not shown) of the press 10 while the punch 11 is reciprocated in a conventional manner, as by eccentrics or cams between a fully closed or bottom dead center position (FIG. 1) and a fully opened position (FIG. 11).

The die or bolster block assembly 12 includes a generally cylindrical upwardly opening recess 13 housing a draw die base 14 which is secured to the assembly 12 by a plurality of hex screws 15 received in a plurality of counter-bored bores 16 and threaded in threaded bores 17 of the assembly 12. There are six such bores 16 and hex screws 15 equally spaced about the draw die base 14 and six similarly spaced threaded bores 17 formed in the assembly 12 for securely attaching the draw die base 14 to the assembly 12 within the recess 13. A bottom wall (unnumbered) of the draw die base includes an axial bore 18 in which is reciprocally moved an upper portion 20 of a knock-out lift ring rod 21.

Figure 2:
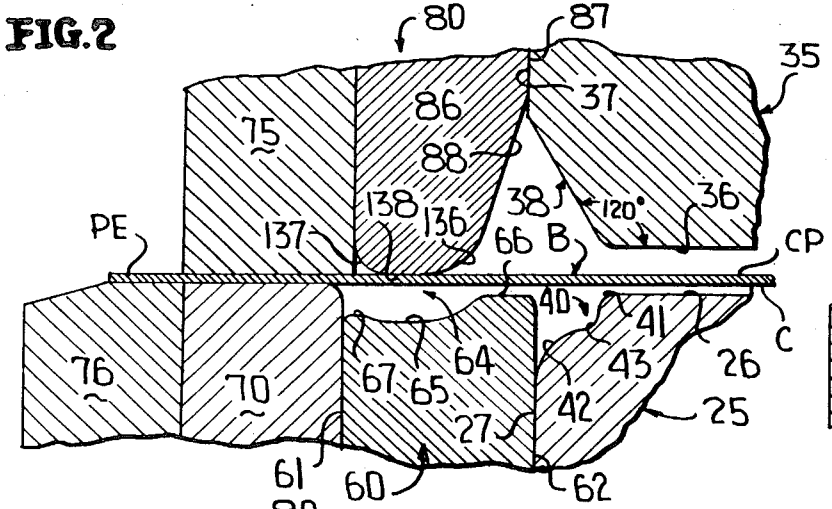
FIG. 2 is an enlarged fragmentary schematic cross-sectional view of the draw punch, reform pad, indent ring and lift ring of FIG. 1, and illustrates the latter in association with the planar metallic blank just prior to the blank being cut between a cutting punch and a cut edge of the die.

The bottom wall (unnumbered) of the draw die base 14 also includes four counterbores 22 of which only one is illustrated in FIG. 1, and a hex screw 23 is received in each counterbore 22 and is threaded in a threaded bore 24 of an indent ring 25 seated within a shallow upwardly opening circular recess 29 of the draw die base 14. The indent ring 25 and a reform pad or draw punch gripper pad 35 of the punch 11, which will be described more fully hereinafter, cooperate to collectively define therebetween means for gripping a central panel CP (FIG. 2) of a metallic uniplanar blank B having an outer peirpheral edge or peripheral edge portioin PE. Essentially, the central portion or center panel CP of the blank B is gripped between a relatively flat terminal circular end face 26 of the indent ring 25 and a similar flat circular terminal end face 36 of the reform pad 35 (FIG. 2).

Figure 7:
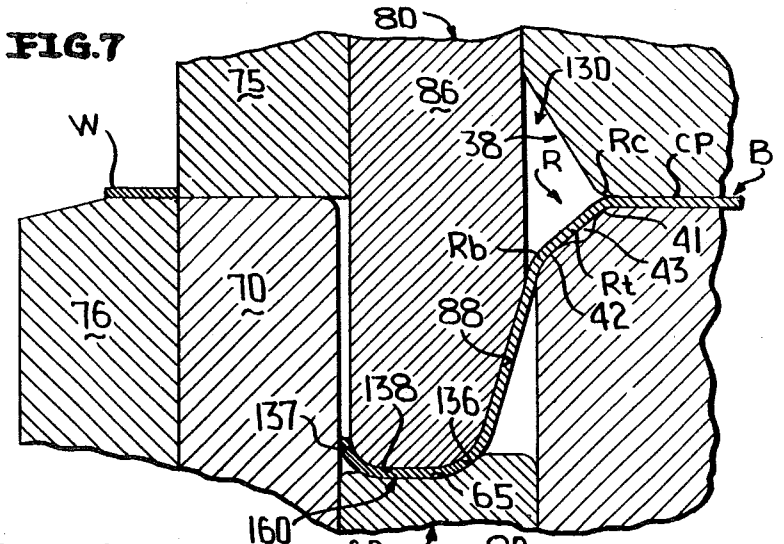
FIG. 7 is an enlarged fragmentary schematic cross-sectional view of the tooling of FIG. 6, and illustrates the draw punch at the bottom of its stroke and a portion of the metallic blank bridging an annular outwardly opening groove of the indent ring.

The indent ring 25 additionally includes a generally cylindrical or peripheral outer surface 27 and the surfaces 26, 27 are bridged by means 40 (FIG. 2) for creating unrestrained tensioning of the blank B during the formation of a somewhat angulated radius R (FIG. 7) defined by a pair of shoulders or radius portions Rb and Rc spanned by an annular generally flat angled wall portion Rt (FIG. 7). The tensioning means 40 includes a pair of annular shoulder 41, 42 between which is an outwardly opening annular groove 43. The radii of the shoulders 41, 42 are respectively 0.030" and 0.065", while the radius of the annular groove 43 is 0.010". The distance of the axis for the radius of the shoulder 42 from the axial terminal end face 26 of the indent ring 25 is 0.015" and the distance of the axis of radius 41 from the axis of the indent ring 25 is approximately 0.976–0.977".

A lower portion (unnumbered) of the indent ring 25 is traversed by a diametric slot 28 which transforms a lower end portion of the indent ring 25 into a pair of legs 30, 31. The diametric slot 28 accommodates reciprocal movement of a hub 61 forming part of a diametric spider (not shown) of a lift ring 60 which will be described more fully hereinafter. However, each of the legs 30, 31 of the indent ring 25 includes a vertical slot 32, 33, respectively, functioning as a vertical limit for reciprocal motion of the lift ring 60.

The draw die base 14 also includes six equally circumferentially spaced bores 34 and six equally circumferentially spaced blind bores 45. Each of the bores 34 receives a reduced end portion 46 of a lift pin 47 while each of the blind bores 45 houses a compression spring 48.

The compression springs 48 bear against the undersurface (unnumbered) of a conventional draw die 70 which cooperates in a conventional manner with a cutting punch 75 of the punch 11 and a cut edge or annular blanking die 76 carried by a die holder or die assembly 78 secured in a conventional manner to the bolster block assembly 12 by a plurality of hex socket screws and nuts 81. Upon the descent of the cutting punch 75, which will be described more fully hereinafter, upon conventional downward motion imparted to the punch 11, the cooperative interaction of the draw die 70, the cutting punch 75 and the cut edge 75 results in the peripheral edge PE of the blank B being blanked or trimmed to a circular configuration as defined by a cut edge CE with, of course, waste material W being eventually discarded during normal operations of the press 10.

The lift ring 60 includes an outer peripheral cylindrical surface 61 and an inner peripheral cylindrical surface 62 which has a groove (unnumbered). The lift ring or annular forming member 60 includes a terminal peripheral end face 64 (FIG. 2) bridging the peripherall surfaces 61 and 62. The terminal peripheral end face 64 includes a shallow upwardly opening convex recess 65, an inboard annular axial face or surface 66 and an outboard annular axial face or surface 67. The surface 66 is radially longer than and slightly above (0.030") the surface 67. The collective surfaces 65 through 67 provide guidance to inward metal flow of the peripheral edge portion PE of the blank B during the downward or forming stroke of the operation and a clamping or gripping action during the upward or reforming stroke, as will be described more fully hereinafter. Downward movement is imparted to the lift ring or annular forming member 60 by the descent of the cutting punch 75. During such downward movement, the lift pins 57 are also moved downwardly moving a lift pin disc 91 out of contact with a bumper retainer plate 92 and further compressing a previously preloaded spring 93 to load the spring 93 to approximately 2,000 lbs. force. The same downward movement of the lift pins 47 and the lift pin disc 91 is transferred to a lift pin spacer 94 which compresses a compression spring 95. The springs 93, 95 operate in a conventional manner, but the same will be described more completely hereinafter.

The bumper retaining plate 92 is secured to the bolster block assembly 12 by a plurality of hex socket screws 96 received in counterbores 97 of the bumper retainer plate 92 and threaded in threaded bores 98 of the bolster block assembly 12. The bolster block assembly 12 also includes a threaded bore 101 into which is threaded an enlarged threaded portion 102 of a lift ring knock-out pumper pad 103 having an axial bore 104 within which reciprocates the knock-out lift ring rod 21.

The punch 11 includes a conventional blank punch slide assembly 110 which has mounted thereto a conventional cutting punch holder 111 by means of a blank ram attachment 112 (only one illustrated) and an associated set screw 113. The cutting punch 75 is secured in a conventional manner, including a cutting punch holder clamping nut 114, to a lower end portion of the cutting punch holder 111.

Figure 9:
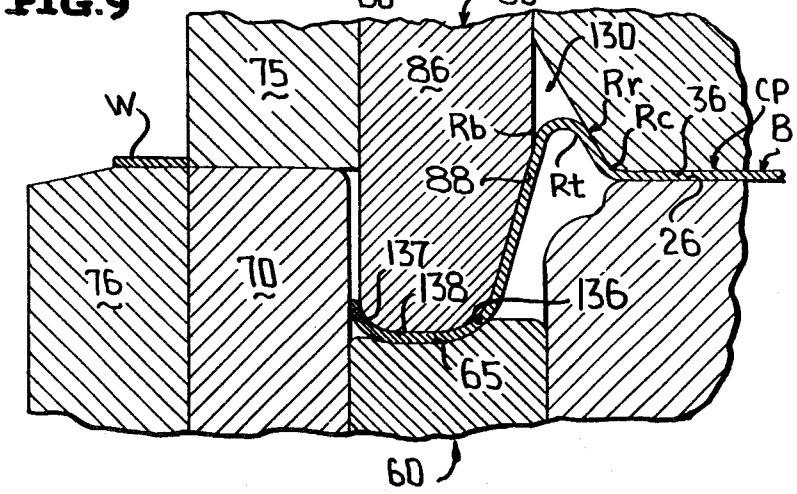
FIG. 9 is an enlarged fragmentary schematic cross-sectional view of the tooling of FIG. 8, and illustrates the position of the tooling at which the reinforcing countersink radius has been fully formed.
Figure 8:
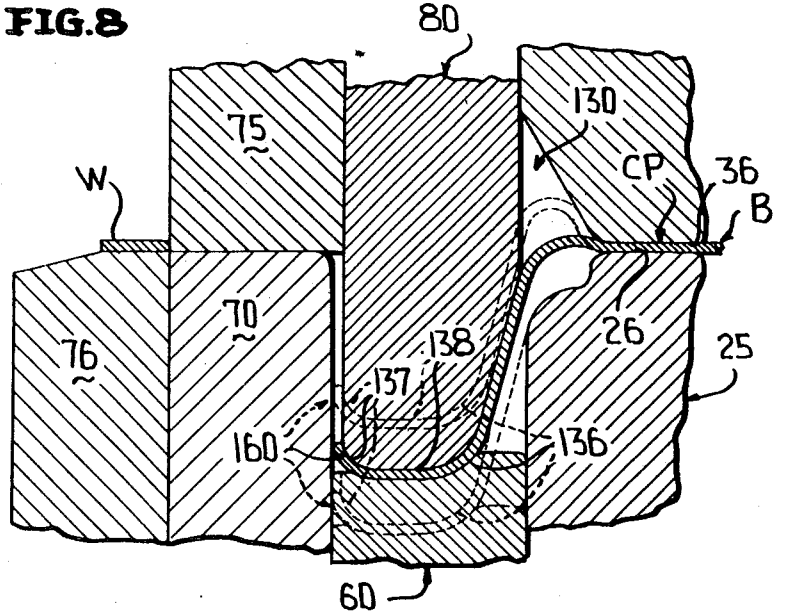
FIG. 8 is an enlarged fragmentary schematic cross-sectional view of the tooling of FIG. 7, and illustrates two phantom outlines and a single solid outline position of the can end during upward movement of the draw punch and lift ring at which time the flange is gripped between the lift ring and the draw punch and the previously formed radius of the can end is progressively formed into a reinforcing countersink radius.

An inner piston or draw punch rod 120 is mounted for reciprocal movement within the cutting punch holder 111 and includes a bore 121, a counterbore 122 and an internally threaded end portion 123. The internally threaded end portion 123 is threaded to a threaded portion 82 of a stem 83 of a draw punch 80. The draw punch 80 includes an axial bore 84 and a counterbore 85 defined by a peripheral skirt or annular forming member 86 of the draw punch 80. The counterbore 85 is defined in part by an inner cylindrical peripheral surface 87 which is in intimate sliding contact with a like outer peripheral cylindrical surface 37 of the reform pad 35. The cylindrical surface 37 and the axial end face 36 of the reform pad 35 are bridged by means 38 in the form of an angled annular surface setting-off an obtuse angle of approximately 120° with the terminal end face 36. A like obtuse angle is set-off between the peripheral surface 37 and the angled annular surface 38. The means 38 functions to prevent a coating C, such as lacquer or enamel, from cracking or being wiped-off and, thus, prevents metal exposure of the eventually formed inner surface of the blank B during the forming and reforming operation. The same means 38 or angled annular surface 38 cooperatively functions with a frusto-conical surface 88 of the draw punch 80 to define therewith and therebetween means for forming an annular downwardly opening and divergiing chamber 130 into which the formed radius R (FIG. 7) can be freely reformed without guidance or restraint (See FIG. 8 and 9) during the upward stroke or movement of the lift ring or annular forming member 60 to eventually form an annular reinforcing countersink radius Rr, again as will be described more fully hereinafter.

The frusto-conical surface 88 merges with a pair of convex radii 136, 137 bridged by a generally flat annular surface 138. The curvature of the radii/surfaces 136 through 138 corresponds to the curvature of the surface 65 of the groove 64 which together therewith provides added guidance to the inward metal flow during the downward or forming stroke when the blank B is formed to its final formed (though not reformed) configuration (FIG. 7).

A hex screw 140 is threaded into a threaded bore (unnumbered) of a draw punch shaft or piston 141 having a blind bore 142, a plurality of seals 143 and a peripheral flange 144 which can bottom against an annular axial end face 145 of the draw punch stem 83. The counterbore or chamber 122 is connected through the port 121 to a supply of fluidic pressure, such as a nitrogen cylinder and an associated regulator assembly or an air amplifier with appropriate valving and controls, which is simply designated by the headed arrow P1. The inner piston or draw punch rod 120 is likewise urged downwardly by fluidic pressure suitably regulated from the same or a different source as the pressure source P1, and the pressure applied to the draw punch rod is generally designated by the reference character P2 associated with the arrow in FIG. 1, although pressures P1, P2 can be equal. The pressure P1 can be, for example, as low as 600 psi and at 1000 psi, the pressure on the piston 141 is approximately 1060 psi. The pressure is preferably higher, particularly the pressure P2 exerted in a downward direction upon the draw punch rod 120 because the latter pressure is transferred during the downward or forming stroke from the rod 120 through the draw punch 80, the lift ring 60 and the lift pins 47 to unseat the lift pin disc 91 and the lift pin saver 94 and, therefore, load the springs 93, 95 which upon the reform, return or upward stroke of the rod 120 provide the mechanical force to lift the rods 47 and the lift ring 60 upwardly to reform the blank b from the position shown in FIG. 7 to that shown in FIG. 9 under a second force greater than the first pressure force P2.

OPERATION

The operation of the press 10 will now be described with particular reference to FIGS. 2 through 11 of the drawings and, of course, it will be assumed that the blank punch slide assembly 110 of the punch 11 has been retracted upwardly to its open position (FIG. 11) with the blank B positioned as shown in FIG. 2, but, of course, being supported upon the flat annular face 66 of the lift ring 60. The means for providing the pressures P1 and/or P2 have been activated and, therefore, the flange 144 of the draw punch piston 141 is bottomed against the annular face 145 (FIG. 1) of the stem 83 of the draw punch 80. This positions the axial terminal face 36 of the reform pad 35 slightly above the flat annular surface 138 of the draw punch 80 (FIG. 2). Upper end faces (unnumbered) of the lift pin disc 91 and the lift pin spacer 94 are in abutment with an undersurface (unnumbered) of the bumper retainer plate 92 (FIG. 1).

Conventional eccentric or cam means lower the cutting punch holder 111 which causes the cutting punch 75 to contact (FIG. 2) the peripheral edge portion PE of the blank B and then sever the same (FIG. 3) forming the cut edge CE. At this position (FIG. 3), the peripheral edge portion PE of the blank B is lightly gripped between the cutting punch 75 and the opposing draw die 70 which slightly compresses the springs 48.

The pressure P2 acting downwardly upon the rod 120 continues to move the draw punch 80 in a downward direction causing initial deformation of the peripheral edge PE of the blank B (FIG. 4) without, at this time, the center panel CP being clamped between the faces 26, 36 of the respective indent ring and reform pad 25, 35. The peripheral edge PE is, however, progressively withdrawn inwardly from between the cutting punch 75 and the draw die 70 (compare FIG. 3 and FIG. 4).

The continued downward fluidic pressure P2 upon the rod 120 progressively moves the draw punch 80 downwardly (FIG. 5) until a point is reached at which the surface 36 of the reform pad 35 contacts the center panel CP of the blank B and clamps the same in conjunction with the opposing surface 26 of the indent ring 25. Thus, from this point (FIG. 5) forward during the continuation of the first or forming operation, the central panel CP remains clamped between the reform pad 35 and the indent ring 25.

Figure 6:
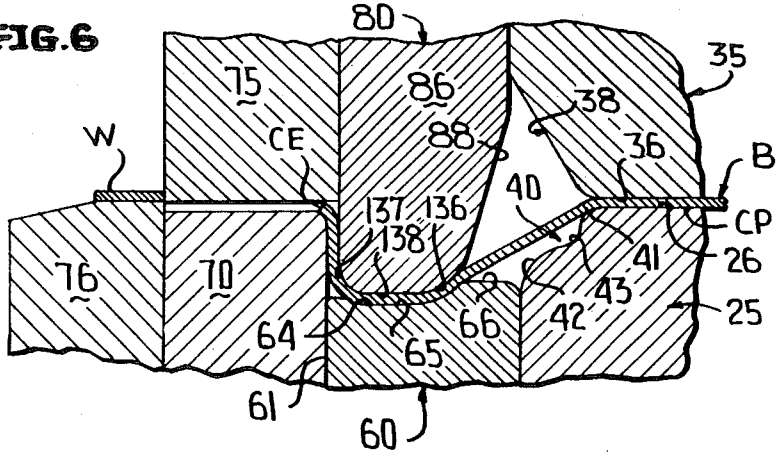
FIG. 6 is an enlarged fragmentary schematic cross-sectional view of the tooling of FIG. 5, and illustrates the simultaneous downward movement of the draw punch and the lift ring at which time a peripheral edge of the metallic blank is guided between respective convex and concave opposing surfaces of the draw punch and lift ring.

Eventually, the downward descent of the draw punch 80 reaches a position at which the force P2 is not only transferred to form the peripheral edge PE of the blank B, but also to act indirectly therethrough to force the lift ring 60 downwardly (FIG. 6). During this action, the groove 64 and the surface 136 through 138 function to guide the inward metal flow as the blank B is progressively formed toward the eventual angulated radius R (FIG. 7). From the position of the lift ring 60 shown in FIG. 6 to that shown in FIG. 7, the downward movement of the draw punch 80 not only forces the lift ring 60 downwardly but this force or pressure P2 is transferred from the lift ring 60 through the lift pins 47 (FIG. 1) to the lift pin disc 91 and from the latter to the lift pin disc 94, thus loading both springs 93 and 95 to obtain upon the return or reform stroke of the press 10 a mechanical force approximately 2000 lbs. Thus, in addition to loading the springs 93, 95, the draw punch 80 also froms the final configuration of the flange 160 (See FIG. 12) but also forms the angulated radius R (FIG. 7) by stretching or tensioning the central portion Rt between the radius Rb and Rc. As will appear more fully hereinafter, the tensioning in the area Rt is believed to provide the marked increase in flexibility of an annular wall portion 152 of a completely formed can end 150 (FIG. 12) while the work hardening of the radius portion Rb coupled with its eventual reforming into the reinforced countersink radius Rr (FIG. 9) results in a "kink" or an increased thickness portion beyond "nominal", thickness at a portion of a countersink radius 155 between the lines of demarcation L6 and L7 of FIG. 12. Thus, from the position generally shown in FIG. 2 to that shown in FIG. 7, the draw punch 80 moved forecefully downwardly by the pressure P2 is effective for exerting forces sufficient to transform the peripheral edge portion PE of the blank B to the configuration of the formed, though not reformed, blank B of FIG. 7.

The reform or return stroke is initiated without any change in position of the blank punch slide assembly 110 and the cutting punch holder 111 and without in anyway reducing the clamping action against the center panel CP of the blank B between the grippng means 25, 35, i.e., the indent ring 25 and the reform page 35. As the spring or springs 93, 95 urge the lift pins 47 upwardly against regulated decrease in the pressure P1 and/or P2 (FIG. 8), a flange 160 of the can end 150 is clamped or gripped between the surfaces 36 through 138 of the draw punch 80 and the surface 65 and the lift ring 60 with a progressive upward movement causing the angulated radius R (FIG. 7) to be deformed progressively out of the plane of the center panel CP of the blank B, as is shown in an initial stage in solid lines in FIG. 8. By comparing FIGS. 7 and 8, it can be seen that the radius portion Rc of FIG. 7 is generally reversed progressively from the position shown in FIG. 7 to that which it eventually reaches in FIG. 9 while at the same time the radius portion Rt is deformed progressively and without restraint, guidance or confinement into the annular channel or chamber 130 until the reinforcing countersink radius (Rr of FIG. 7 or 155 of FIG. 12) is fully formed. However, during the movement of the lift ring 60 and the draw punch 80 as aforesaid between the position shown in FIGS. 8 and 9, the earlier tension portion Rt of the radius R tends to deform or bend more readily as opposed to the work hardened portion Rh which characteristically creates a relatively tight raduis Rr and the reinforced thickened "kink" between the lines of demarcation L6, L7 (FIG. 12).

Figure 10:
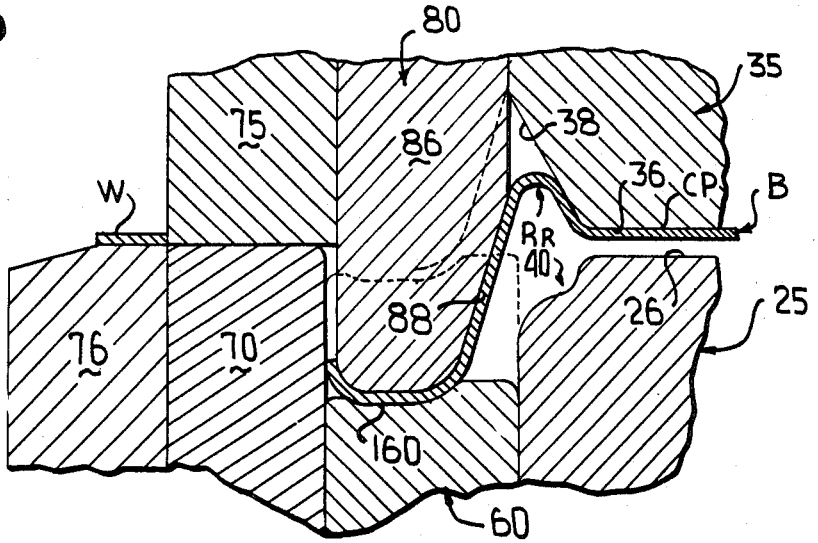
FIG. 10 is an enlarged fragmentary schematic cross-sectional view of the tooling of FIG. 9, and illustrates in solid outline the release of the gripping forces by the retraction of the reform pad and in phantom outline the position of the lift ring prior to final ejection of the fully formed can end.

Upon completion of the return or refroming stroke (FIG. 9), the presure P1 on the draw punch shaft 141 (FIG. 1) is released or lessened and unclamping of the blank B occurs as the lift ring 60 continues it upward spring biased return under the mechanical force of the springs 93 and/or 95 until the phantom outline position of FIG. 10 is reached by the lift ring 60. Thereafter, the cutting punch holder 111 is mechanically retracted to the final position shown in FIG. 11 at which point the can end can be conventionally ejected.

Figure 12:
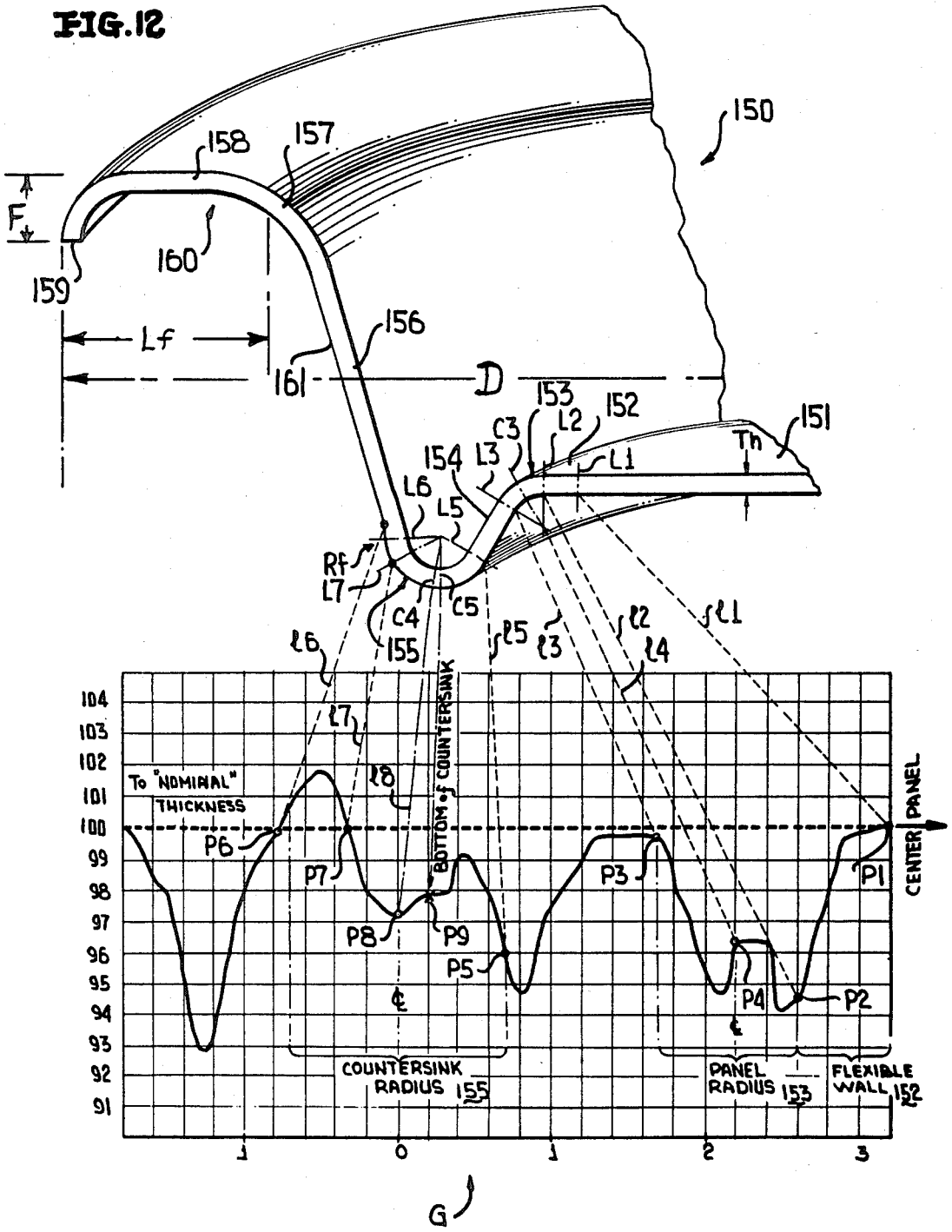
FIG. 12 is a fragmentary cross-sectional view of a reinforced pressure resistant can end constructed in accordance with this invention, and illustrates in conjunction with a graph a variety of different wall thicknesses thereof pertinent to the present invention.

Reference is now made to FIG. 12 of the drawings which best illustrates the resultant reinforced pressure resistant can end generally designated by the reference numeral 150.

The can end 150 includes a generally circular center panel or panel portion 151, a flexible annular wall portion 152, a panel radius 153, a frusto-conical peripherally inner wall 154, an annular exteriorly upwardly opening reinforcing countersink radius or channel 155, a frusto-conical peripherally outer wall 156, a radius 157, an annular end wall 158 and a peripheral edge 159 with the latter three portions collectively defining a flange 160 which is utilized in a conventional manner to double seam the can end 150 to the can body.

A graph G has been associated with the can end 150 of FIG. 12 to graphically illustrate the variaiton in cross-sectional wall thickness of the can end 150 from the central panel 151 to the frusto-conical peripherally outer wall 156. The graph G depicts the percentage of change in gauge or thickness along the ordinate and the abscissa depicts the change in gauge using the countersink radus 155 as the "0" point. The end is a 206 diameter "Carson" shell.

The gauge or cross-sectional wall thickness of the circular central panel 151 of the can end 150 is generally designated by the reference character Tn and on the graph G, this "nominal" thickness is represented by the horizontal dash line at "100". A line L1 represents the point of demarcation between the circular central panel 151 and the flexible annular wall portion 152, although it must be recognized that the position of the line L1 is not exact but is amply adequate to understand the present invention and the variations in the gauge or wall thicknesses throughout the can end 150, as will become clear hereinafter. A line l1 has been used to reference the line of demarcation L1 with a point P1 on the graph G to indicate that to the right of the point P1, the "nominal" or unformed thickness of the center panel 151 corresponds to the "nominal" thickness of the blank B prior to initiating the forming operation. A line of demarcation L2 indicates the outboard extent of the flexible annular wall portion 152 and the line l2 therefrom to the point P2 indicates on the graph G a progresive thinning of the cross-sectional thickness of the flexible annular wall portion 152 from the point P1 to point P2.

Another line of demarcation L3 sets-off with the line L2 the extent of the panel radius 153 with a center line of the panel radius 153 being designated by the line C3. A line l3 connects the line L3 with a point P3 on the graph G, while another line l4 connects the line C3 with a point P4 of the graph G. The configuration of the curve passing between the points P2 and P3 indicates the wall thickness or gauge of the panel radius 153 essentially decreases from the line L2 and then increases at the area of the line C3 (point P4) after which the cross-sectional thickness again abruptly decreases and increases toward the point P3 and the line L3. The increased thickness generally in the ara of the point P4 as compated to the progressive thinning of the annular wall portion 152 between the points P1 and P2 renders the annular wall portion 152 somewhat more flexible than both the center panel 151 and the panel radius 153 thereby permitting the annular wall portion 152 to flex under abuse, excess internal pressure, or the like, without failure.

Another line of demarcation L5 sets-off the frusto-conical peripherally inneer wall 154 with the line L3. A line l5 from the line of demarcation L5 to a point P5 establishes the progressive decrease in wall thickness or gauge of the frusto-conical peripherally inner wall 154 from a point just beyond point P3 toward, but not quite to, point P5.

The reinforcing countersink radius 155 is set-off between the line of demarcation L5 and another line of demarcation L6 between the two of which is a a line C4 representing the radius of the countersink 155 and a line C5 indicating the bottom of the countersink 155. Another line of demarcation L7 is illustrated radially inward of the line of demarcation L6. Lines l6 and l7 connect the respective lines L6, L7 with points P6 and P7, respectively, of the graph G. Similarly, lines l8 and l9 connect the lines C4, C5, respectively, with points P8 and P9, respectively, of the graph G. the significance of the latter described structure is the significant increase from the "nominal" thickness between the points P6 and P7 which results in a thickening, compression, or bulging of the material between the lines of demarcation L6 and L7 and slightly radially outwardly beyond the line L6. The material in this area is visibly "kinked" exteriorly, and the exterior surface (unnumbered) of the portion of the countersink radius 155 and the frusto-conical wall 156 generally between the lines of demarcation L6 and L7 bulges outwardly beyond an outer surface 161 of the frusto-conical wall 156 which, of course, from the graph G is seen to progressively thin beyond point P6. The portion of the countersink radius between the lines of demarcation L6 and L7 corresponds generally to the radius (FIG. 7) which is believed to be slightly work-hardened during the initial forming operation, and this attendant loss of flexibility permits not only the unrestrained reforming (FIGS. 8 and 9) of the radius R to the configuration of the radius Rr in FIG. 9, but also the accumulation of metal in this same area (between the lines L6 and L7). The increased thickness in the countersink radius 155 at generally the radially outbaord portion Rf (FIG. 12) of the can end 150 results in desired end reinforcement whereas the progressively thinner annular wall portion 152 results in desired end flexiblity.

The can end 150 of FIG. 12 is, of course, constructed in the absence of metal exposure, as was heretofore noted, and the coating C remains essentially homogeneous and uninterrupted on the inner surface (unnumbered) of the can end. This is, of course, achieved with flange height (F), flange length (Lf) and concentricity (D) (FIG. 12) well within design tolerances.

Variations in the present method and apparatus will become apparent to those skilled in the art and such are considered to be within the scope of this disclosure including various modifications in or reversal of the the various elements heretofore described. As an example, reference is made to FIGS. 13 and 14 which have been provided with like, though primed, reference numerals to identify structure identical to that illustrated respectively in FIGS. 7 and 9. In this case, the reform pad 35' has been modifeid by altering the overall configuration of adjoining surfaces 170 through 172 bridging the surfaces 36' and 37'. The surface 170 is of an angular configuration, similar to the surface 38 of the reform pad 35. However, the surface 172 is radially outboard of the corresponding radius 41' of the indent ring 25' and as a result the annular downwardly opening chamber 130' abruptly narrows at the cylindrical surface 171'. Thus, upon the return stroke or reform stroke upwardly of the lift ring 60', the radius R'r is "tighter", as is most readily apparent by simply comparing the radius Rr of FIGS. 9 through 10 with the radius R'r of FIG. 14. This results in a more rigid reinforcement of the countersink radius 155' than that provided by the refinforcinig radius 155.

It is also readily apparent and within the scope of the present invention to essentially reverse or flip-flop the position of the reform pad 35 and draw punch 80 relative to the indent ring 25 and lift ring 60. In other words, it is clearly within the scope of this invention to have the indent ring 25 and lift ring 60 carried by the draw punch rod 120 and the reform pad 35 and draw punch 80 carried by the die or bolster block assembly 12.

Figure 15:
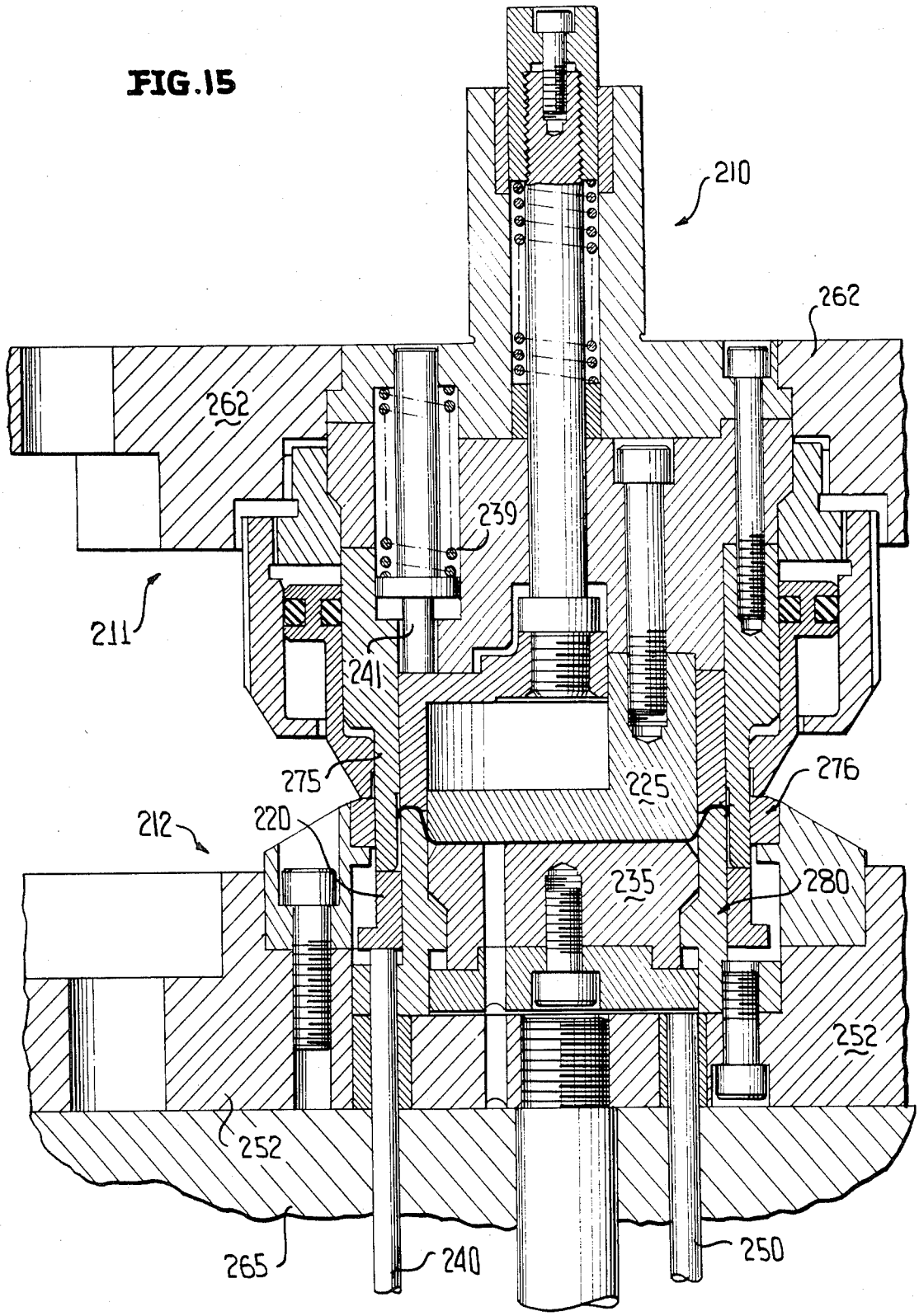
FIG. 15 is a generally fragmentary axial sectional view of another press including another punch and die, and illustrates the tooling thereof in a position forming the configuration of the can end or shell of FIG. 18.

A modification as aforesaid is illustrated in FIG. 15 of the drawing in which a press or tool assembly 210 is illustrated and comprises a punch or upper tool 211 and a die or lower tool 212. The upper tool 211 includes a cutting punch or sleeve 275, a holding ring or lift ring 260 within the cutting punch or sleeve 275 and a first draw punch 225. The components 225, 260 and 275 of the tool assembly 210 will be seen to correspond to the like components 25, 60 and 75 of the press 10. The lower tool 212 includes a blanking die or cutting ring 276, a first draw die 280 surrounded by an annular ring 220 in alignment with the cutting sleeve 275 and a second or "redraw" punch or reform pad 235 within the first draw die 280. The elements 235 and 280 correspond to the elements 35 and 80 of the press 10.

The upper tool 211 is mounted in a top plate 262 of a pillar die set comprising at the top plate 262 a plurality of conventional guide pillars (not shown) and a bottom plate 252 which can reciprocate relative to the top plate 252 and during such movement is guided by the latter-noted pillars. The tool or die assembly 210 of FIG. 15 is mounted in a "C" framed power press on a press plate 265 so that the top plate 262 is urged to reciprocate by the press ram (not shown) and the bottom plate 252 remains stationary on the press plate 265.

Figure 16:
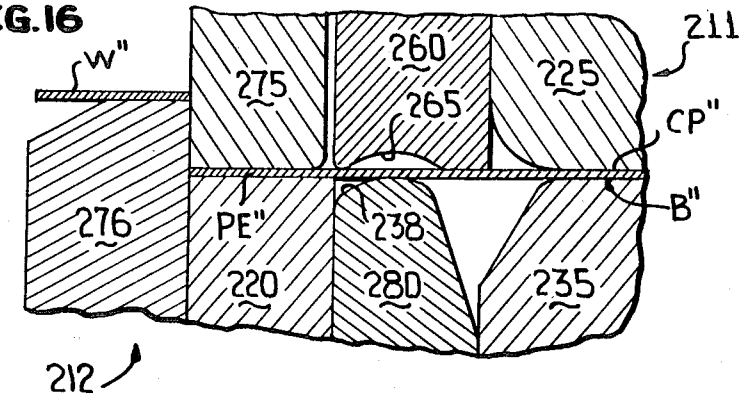
FIG. 16 is an enlarged fragmentary schematic cross-sectional view of a draw punch, reform pad, indent ring and lift ring of FIG. 15, and illustrates the latter in association with a metallic blank which has been cut between a cutting punch and a cut edge of the die.

In use, a sheet of metal is placed between the upper tool 211 and the lower tool 212 and the tools are closed by movement of the press ram acting on the top plate 262 so that the cutting sleeve 275 cooperates with the cutting ring 276 to cut out a circular blank B" (FIG. 16) with the waste material being designated by the reference character W". As in the case of the blank B of FIGS. 2 through 11 of the drawings, the bland B" includes a central panel CP' and a peripheral edge PE".

Figure 17:
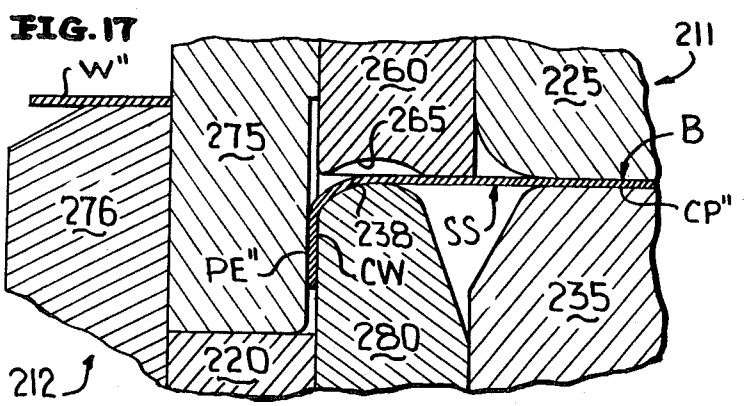
FIG. 17 is an enlarged fragmentary cross-sectional view of the tooling of FIG. 16, and illustrates a further sequence in the operation of the punch during which the blank is formed into a shallow cup.

After the cut-out of the circular blank B", continual downward travel of the press ram urges the top plate 262 of the die assembly to push the sleeve 275 downwardly and through the peripheral edge PE" of the blank B" also pushes the annular ring 220 downwardly toward the position shown in FIG. 17. During the motion of the sleeve 275 and the annular ring 220 from the position shown in FIG. 16 to the position shown in FIG. 17, the peripheral edge PE' is formed over a convex surface 238 of the first draw die 280 with the sleeve 275 and the annular ring 220 functioning as a spring blank holder from between which the peripheral edge PE" is eventually withdrawn into the sandwiched relationship between the sleeve 275 and the die 280 to shape the peripheral edge PE" into a shallow downwardly opening shallow shell SS (FIG. 17) defined by a substantial cylindrical wall CW and the central panel CP". The downward motion of the first drawing operation compresses a spring (not shown but correspondng to the spring 93 of FIG. 1) through push rods 240 (FIG. 15) so that the blank holding or clamping pressure between the sleeve 275 and the annular ring 220 is controlled as metal is drawn over the face 238 of the draw die 280 to form the inverted shallow shell or cup SS of FIG. 17. The continued drawing moves the punch 225 and the second punch 235 downwardly toward the position shown in FIG. 18 in which the blank B" corresponds generally to the blank B of FIG. 7, except, of course, the now cup-shaped blanks B, B" open in opposite directions (downwardly in FIG. 7 and upwardly in FIG. 18). The central panel CP" is, of course, clamped between the punch 225 and the punch 235 during the movement thereof from the position shown in FIG. 17 to the position shown in FIG. 18, and during this downward movement, the peripheral edge PE" is drawn over the convex edge 238 of the die 280, as earlier noted. It is after this formation of the peripheral edge PE" toward the end of the stroke shown in FIG. 18 that the holding ring 260 moves downwardly and now clamps the now formed cover hook or flange 260' (FIG. 18) between the surfaces 238, 265 of the respective tooling elements 280, 260. The holding ring 260 is resiliently urged to act against the flange 260' on the surface 238 of the die 280 by springs 239 (FIG. 15) and rods 241 in the upper tool 211 as the punch or indent rings 225 begins to retract upon the return motion of the press ram.

Figure 19:
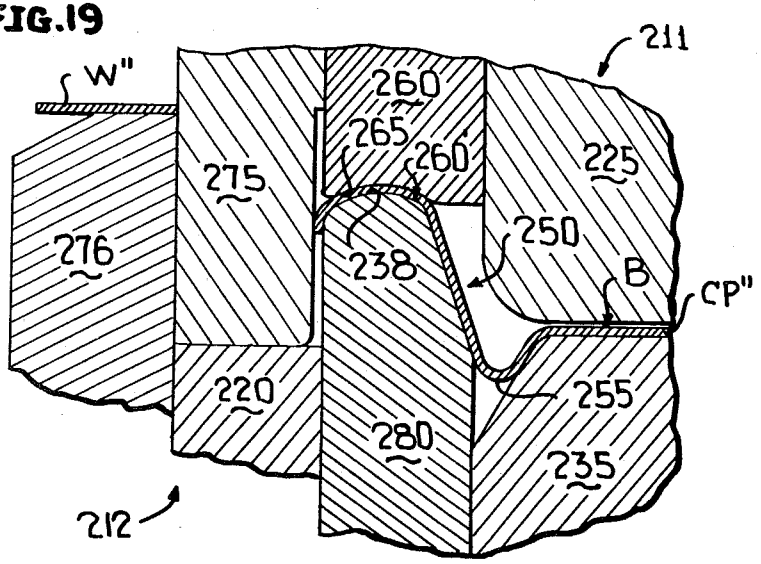
FIG. 19 is an enlarged fragmentary schematic cross-sectional view of the tooling of FIG. 18, and illustrates the position of the tooling at which a reinforcing countersink radius has been fuly formed.
Figure 18:
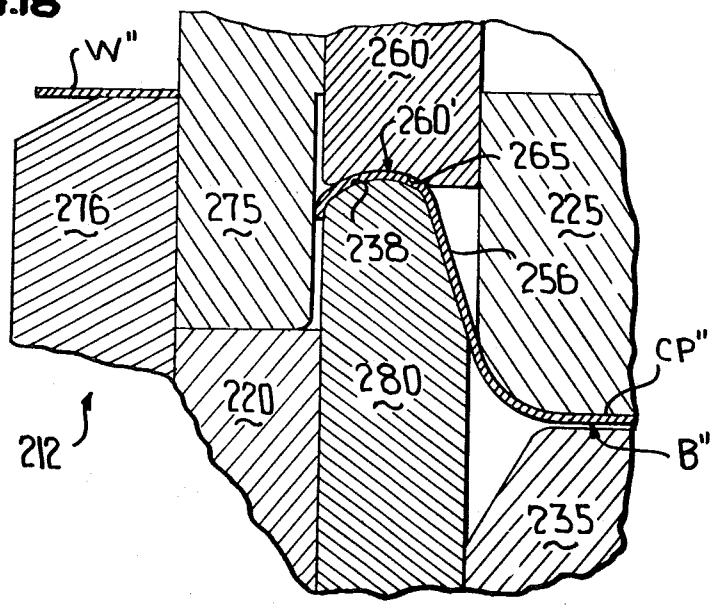
FIG. 18 is an enlarged fragmentary schematic cross-sectional view of the tooling of FIG. 17, and illustrates the tooling at the bottom of its stroke after the shallow cup of FIG. 7 has been reformed to an oppositely opening flanged cup.

The return motion of the press ram permits the punch 280 to cooperate with the redraw punch 235 of the lower tool 212 which is urged by a compression spring (not shown but acting through a cross-head and a plurality of rods 250) to progressively reform or deflect the center panel CP" from the position shown in FIG. 18 to that of FIG. 19. The latter movement progressively generates the reinforced countersink radius or anti-peaking radius 255 by a folding action essentially identical to that heretofore described relative to FIGS. 8 and 9 of the drawings. Thus, the eventually formed end or shell 250 corresponds in structure and function identically to that heretofore described relative to the end or shell 150 (FIGS. 11 and 12).

A detailed construction of the various push rods and springs under the press plate 265 are readily understood by those skilled in the art who will also appreciate that springs such as those operating the rods 240, 250 could be replaced by other resilient devices, such as a gas cushion or hydraulic cylinders as forming operations may dictate. If preferred, a power press having a second powered action may be used.

Variations are also well within the scope of the invention as heretofore described relative to FIGS. 15 through 19 of the drawings, and one such variation is apparent from FIG. 18 to which attention is now directed. If during the first downward movement of the draw punch 225 the motion was continued beyond the position shown in FIG. 18, the frusto-conical surface 256 would merge with a cylindrical wall portion (not shown) before merging with the unnumbered radius of the blank B". When such a can end is reformed, the cylindrical portion is pulled radially inward but any spring-back of the fold of the radius or anti-peaking bead 255 can be used to compensate for relaxing the curve of the anti-peak bead.

In both the modification just described and that specifically described relative to the press 10, while it is highly desirable to use fluidic pressure (P1 and/or P2), it is also considered within the scope of this invention to selectively operate the draw punch rod 120 and the draw punch piston 141 through separate cams or eccentrics such that the springs 93 and/or 95 can be loaded during the forming stroke under mechanical as opposed to fluidic pressure. The reform pad 35 may also be biased downwardly by a mechanical spring rather than the fluidic/pneumatic pressure P1.

Thus far, the invention has been directed to the manner in which a can end 150 (FIGS. 11 and 12) can be formed, but the invention is equally well directed to the manufacture of an integral one-piece drawn and/or wall ironed can which, instead of the shallow flange 160 (FIG. 11), the peripheral edge 159 continues on as a cylindrical can body. In this case, the draw die 70 and the cutting punch 75 must be of a larger diamater so that the blank B (FIG. 2) is of a larger initial diameter. By substituting a larger diamered draw die and cutting punch for the draw die 70 and the cutting punch 75, a gap is provided between the draw die 70 and the lift ring 60 for receiving a die set (as in U.S. Pat. No. 3,908,429 in the name of Martin M. Gram, issued on Sept. 30, 1975). By positioning the cutting punch 75 and the draw die 70 as at 72 and 71 in the latter patent, the die set 52 of the latter can be likewise positioned to permit the larger diametered blank to be drawn, wall ironed and eventually formed into an integral one-piece can body having an appropriately reinforced end, as will be more readily apparent hereinafter relative to the discussion of FIGS. 20 through 28 of the drawings.

In FIGS. 20 through 28 of the drawings, the parts of the punch and die of FIG. 1, and particularly the draw punch, reform pad, lift ring and indent ring have been prefixed by "300" to designate structure generally identical to that heretofore discussed relative to FIGS. 1 through 11 of the drawings. For example, in FIGS. 20 through 28, a draw punch has been designated by the reference numeral 380, a reform pad by the reference numeral 335, a lift ring by the reference numeral 360, and an indent ring by the reference number 325. As was noted earlier, since a set of wall ironing/drawing dies are outboard of the lift ring 360, neither the draw die nor cutting punch, corresponding to the elements 70 and 75 of FIGS. 1 through 11 of the drawings, have been illustrated. Furthermore, since the draw punch 380, the reform pad 335 and the indent ring 325 are identical in structure and function to the respective draw punch 80, reform pad 35 and indent ring 25 of FIGS. 1 through 11, a further description is unnecessary for a complete understanding of this portion of the disclosure. However, the lift ring 360 includes an outer peripheral cylindrical surface 361, an inner peripheral cylindrical surface 362 and a terminal peripheral end face which is generally designated by the reference numeral 364. The terminal peripheral end face 364 bridges the peripheral surfaces 361, 362 and includes an annular axial face or surface 367, a shallow upwardly opening convex recess 365 inboard thereof, a relatively deep axially upwardly opening annular channel 369 and an inboard annular axial face or surface 366.

Figure 20:
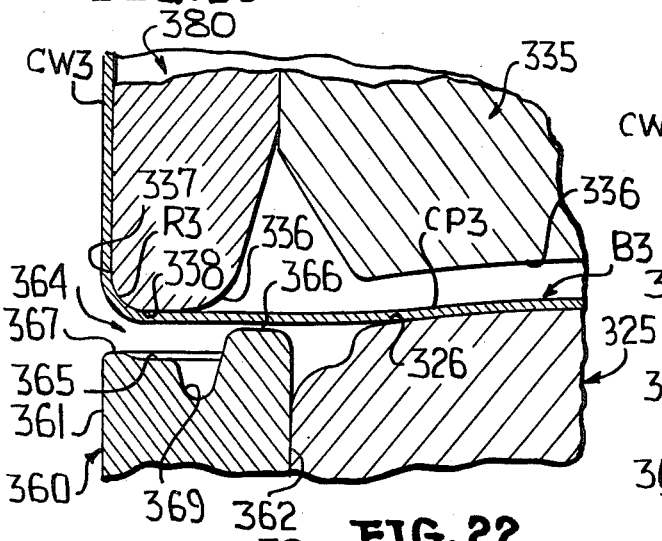
FIG. 20 is a fragmentary schematic axial cross-sectional view of another press including a punch and die corresponding generally to the press of FIG. 1 and including another draw punch, reform pad, indent ring and lift ring, but in this case the same are contoured to form a drawn/wall-ironed one-piece metallic can body having a can end or bottom with an integral reinforcing bead and stacking bead, and illustrates the punch and die parts in association with a cup-shaped metallic blank after the blank has been cut between a cutting punch and cut edge of the die, as in FIG. 3, and drawn between the unillustrated female drawing/wall-ironing dies to form a cylindrical can body and bottom or end.

As is best illustrated in FIG. 20, a generally cup-shaped blank B3 is shown after the same has been formed from a planar metallic blank trimmed by the larger cutting punch 75 and cut edge 76 heretofore noted, and drawn through the set of dies corresponding to the dies 52 of U.S. Pat. No. 3,908,429. All of the latter is accomplished by the exertion of a first force against the blank B3 in a downward direction through downward movement of the draw punch 380 and the reform pad 335 resulting in the blank B3 being contoured to include a central panel CP3, a radius R3 and a cylindrical wall CW3 whose uppermost edge (not shown) extends a considerable height above the radius R3. The uppermost raw peripheral edge (not shown) of the cylindrical wall CW3 is subsequently trimmed and flanged radially outwardly so that an end might be seamed thereto in a conventional manner, thus forming a two-piece can.

Figure 3:
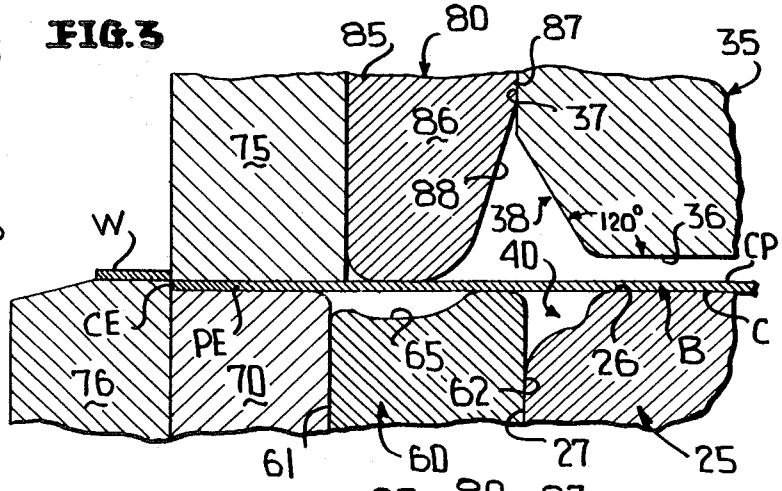
FIG. 3 is an enlarged fragmentary schematic cross-sectional view of the tooling of FIG. 2, and illustrates a further sequence in the operation of the punch during which the blank is cut between the cutting punch and the die cut edge.
Figure 5:
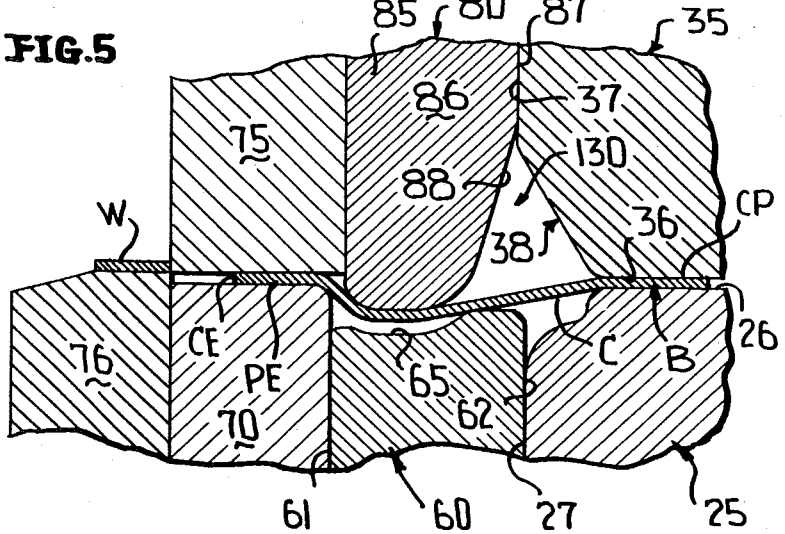
FIG. 5 is an enlarged fragmentary schematic cross-sectional view of the tooling of FIG. 4, and illustrates the position at which a central portion of the metallic blank is clamped between axial end faces of the reform pad and the indent ring.
Figure 4:
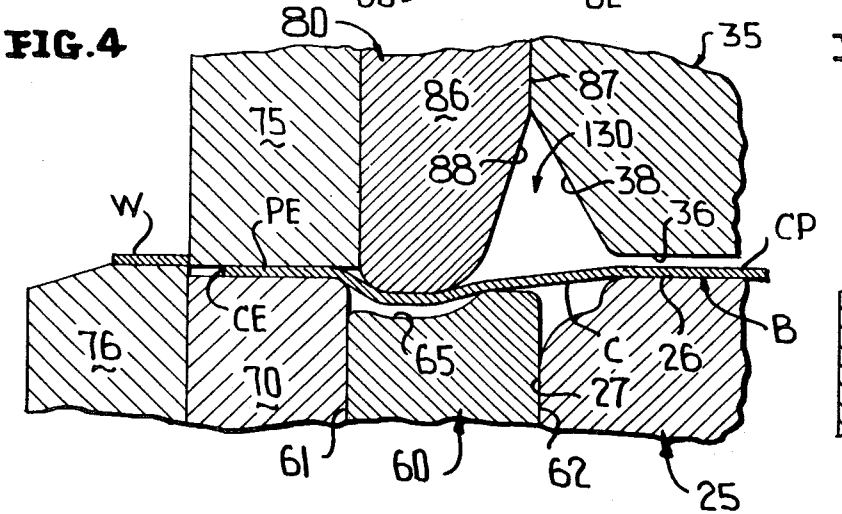
FIG. 4 is an enlarged fragmentary cross-sectional view of the tooling of FIG. 3, and illustrates a generally convex axial end face of the draw punch applying downwardly directed forces to a peripheral edge portion of the blank.
Figure 21:
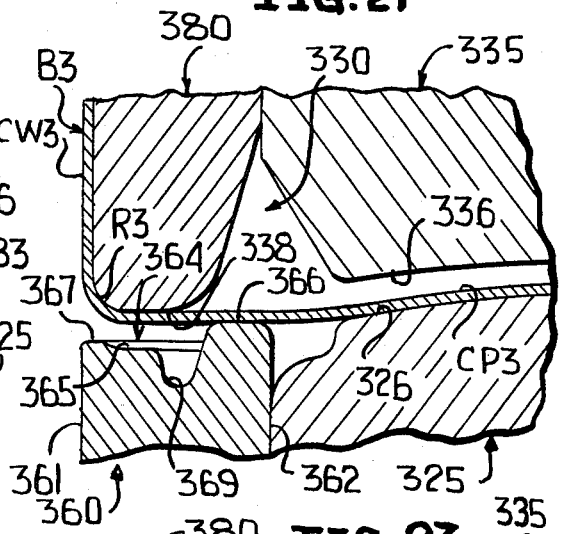
FIG. 21 is a fragmentary schematic cross-sectional view of the tooling of FIG. 20, and illustrates a further sequence in the operation of the press during which the draw punch and reform pad move closer toward the lift ring and indent ring.
Figure 22:
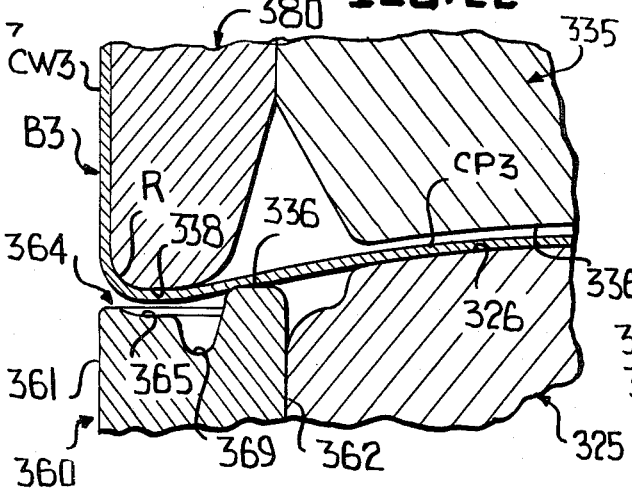
FIG. 22 is a fragmentary cross-sectional view of the tooling of FIG. 21, and illustrates a generally convex axial end face of the draw punch applying downwardly directed forces to a peripheral outboard portion of the cup-shaped blank between the cylindrical body and end panel thereof.
Figure 23:
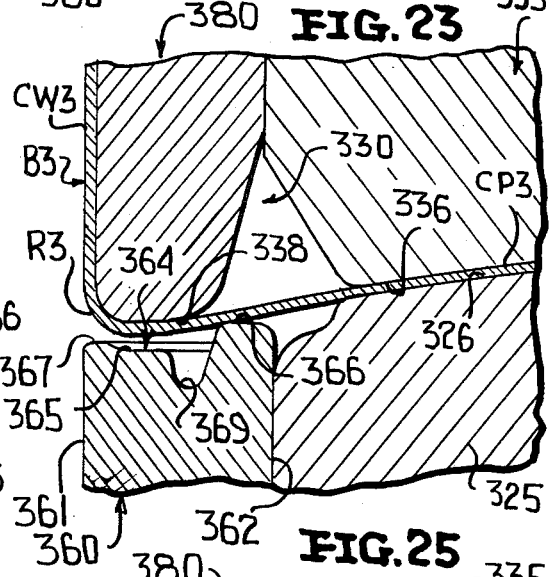
FIG. 23 is a fragmentary schematic cross-sectional view of the tooling of FIG. 22, and illustrates the position thereof at which a central portion of the cup-shaped blank is clamped between axial end faces of the reform pad and the indent ring.
Figure 24:
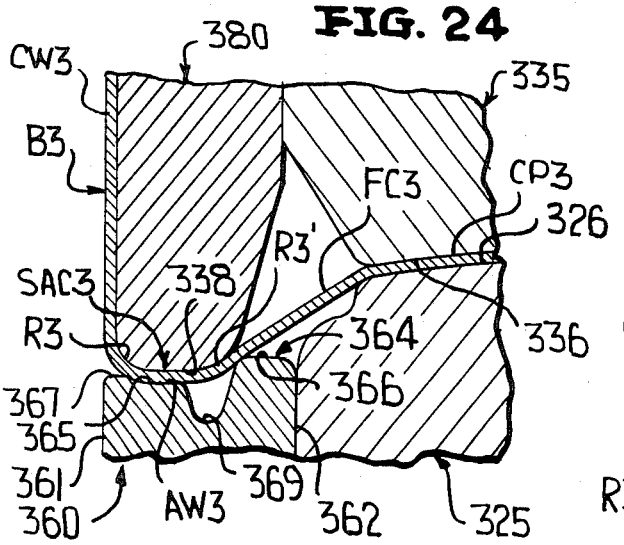
FIG. 24 is a fragmentary schematic cross-sectional view of the tooling of FIG. 23, and illustrates the simultaneous downward movement of the draw punch and the lift ring at which time the peripheral outboard portion of the cup-shaped blank is drawn radially inwardly between respective convex and concave opposing surfaces of the draw punch and lift ring to progressively form a frusto-conical wall between a central portion of the end and a shallow channel of the can bottom adjacent the cylindrical body.

FIGS. 21 through 23 illustrate the successive positions of the draw punch 380 and the reformed pad 335 heretofore described relative to FIGS. 3 through 5, respectively, and the corresponding draw punch 80 and reform pad 35 thereof. It need but be noted that in FIG. 23 a point is reached at which the surface 336 of the reform pad 335 contacts the center panel CP3 of the blank B3 and clamps the same in conjunction with the opposing surface 326 of the indent ring 325. Thus, from this point (FIG. 23) forward during the continuation of the first, forming, drawing and wall ironing operation, the central panel CP3 remains clamped between the reform pad 335 and the indent ring 325.

Eventually, the downward descent of the draw punch (80 of FIG. 1) reaches a position at which the blank B3 has been totally formed to its cup-like configuration and has been completely withdrawn from between the unillustrated female drawing and wall ironing dies, as at 52 in U.S. Pat. No. 3,908,429. Once the drawing and wall ironing has been completed, the draw punch 380 continues downwardly (FIG. 24) drawing a portion of the cylindrical wall CW3 radially inwardly between the surfaces 338 of the draw punch 380 and 365 of the lift ring 360 resulting in the formation of a shallow upwardly opening annular channel SAC3. The shallow annular channel SAC3 is defined by the radius R3, an annular wall AW3, and an inboard radius R3'. The radius R3' merges with a frusto-conical wall FC3 which in turn merges with the central panel CP3.

As the draw punch 380 continues its descent (FIG. 24), the material of the cylindrical wall CW3 continues to be drawn between the surfaces 338, 365 until the frusto-conical wall FC3 of FIG. 4 is generally contoured into a pair of frusto-conical walls FC3' and FC3'' bridged by a radius R3''. Just as in the case of the operation of the dies described relative to FIGS. 6 and 7, the end face 364 and the surfaces 336, 337 and 338 function to guide the inward metal flow as the blank B3 is progressively formed to the configuration of FIG. 25. From the position of the lift ring 360 shown in FIG. 24 to that shown in FIG. 25, the downward movement of the draw punch 380 not only forces the lift ring 360 downwardly, but this force is transferred from the lift ring 360 through the lift pins 47 (FIG. 1) to the lift pin disc 91 and from the latter to the lift pin disc 94, thus loading both springs 93 and 94 to obtain upon the return or reform stroke of the press 10 the same mechanical return force noted earlier relative to FIGS. 1 through 11, namely, 2000 pounds. Obviously, the same tensioning corresponding to the tensioning of the area RT (FIG. 9) heretofore described is also achieved in conjunction with the formation of the blank B3 during the stroke of the components between positions shown in FIGS. 23 through 25.

Figure 25:
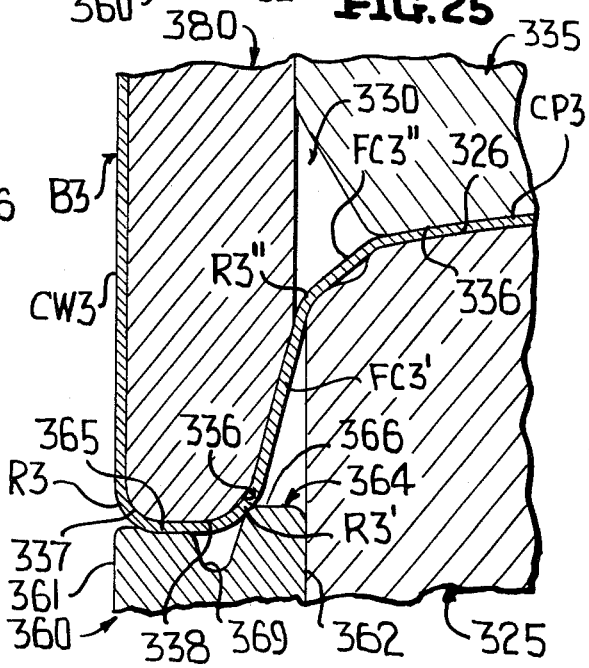
FIG. 25 is a fragmentary schematic cross-sectional view of the tooling of FIG. 24, and illustrates the draw punch at the bottom of its stroke and the frusto-conical wall formed into two frusto-conical wall portions.
Figure 26:
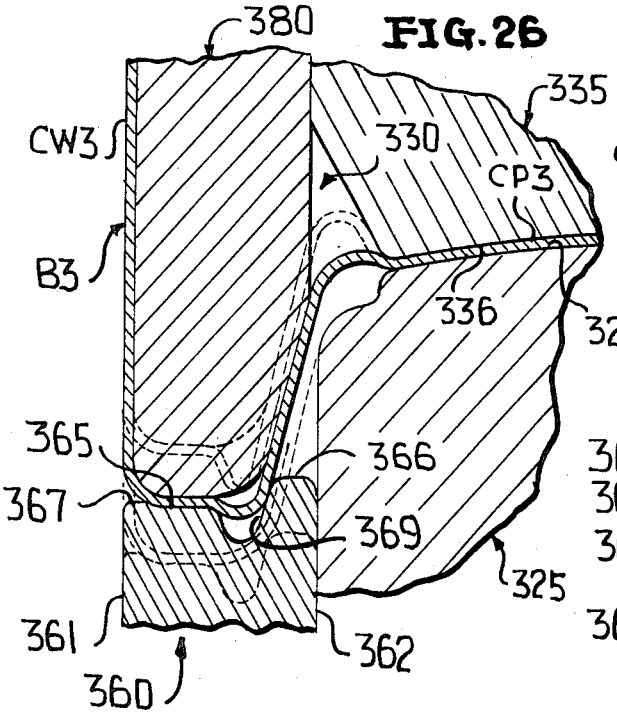
FIG. 26 is a fragmentary schematic cross-sectional view of the tooling of FIG. 25, and illustrates two phantom outline positions and a single solid line position of the can end or bottom during upward movement of the draw punch and lift ring at which time the frusto-conical wall portions are progressively formed into a reinforcing countersink radius or annular bead and a stacking annular bead.
Figure 27:
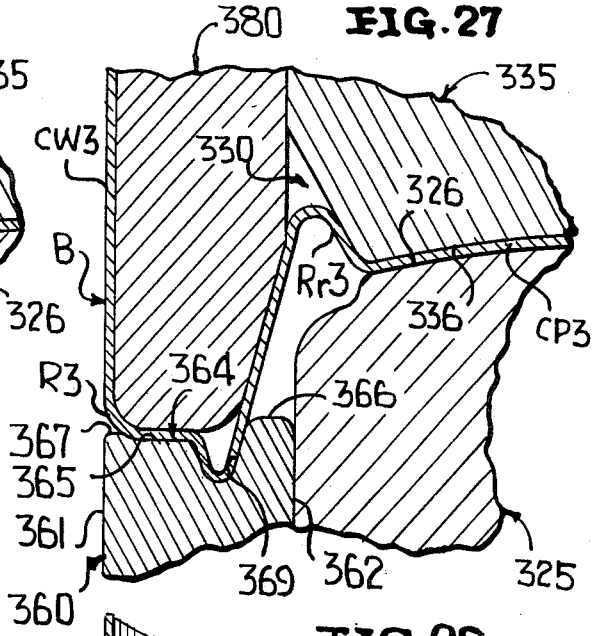
FIG. 27 is a fragmentary schematic cross-sectional view of the tooling of FIG. 26, and illustrates the position of the tooling at which the reinforcing countersink annular bead and the stacking annular bead have been fully formed.
Figure 28:
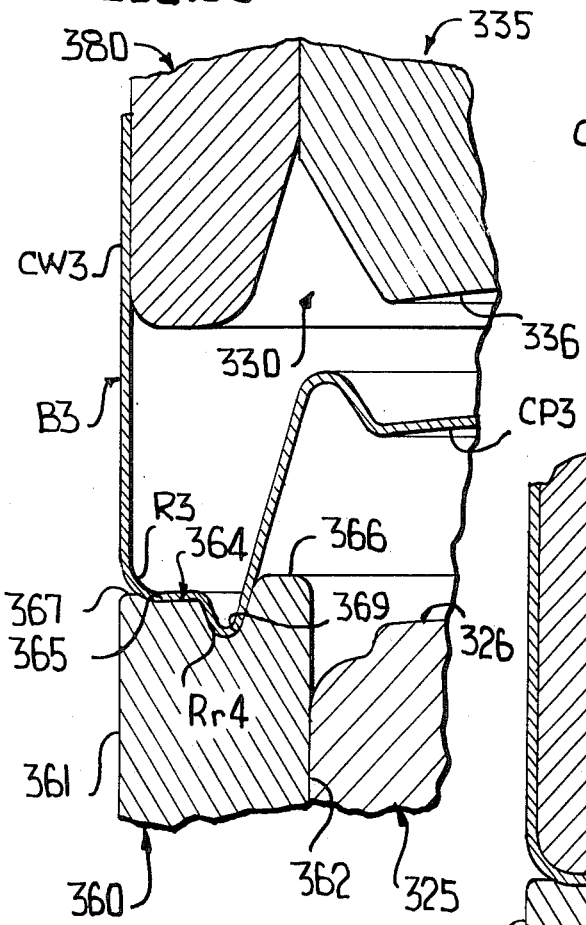
FIG. 28 is a fragmentary schematic cross-sectional view of the tooling of FIG. 27, and illustrates the release of the can bottom by the retraction of the reform pad prior to complete opening of the press and the ejection of the fully formed can.
Figure 36:
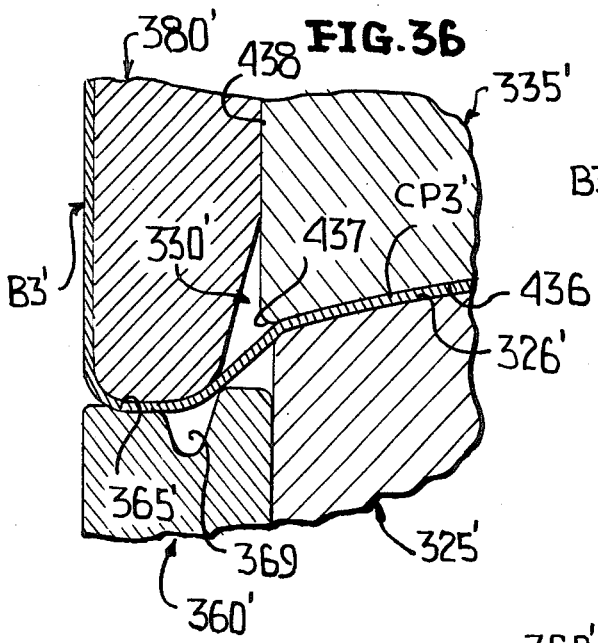
FIG. 36 is an enlarged fragmentary schematic cross-sectional view of the tooling of FIG. 35, and illustrates the simultaneous downward movement of the draw punch and the lift ring at which time the peripheral outboard portion of the metallic cup-shaped blank is drawn radially inward between respective convex and concave opposing surfaces of the draw punch and lift ring to progressively form a frusto-conical wall therebetween.
Figure 37:
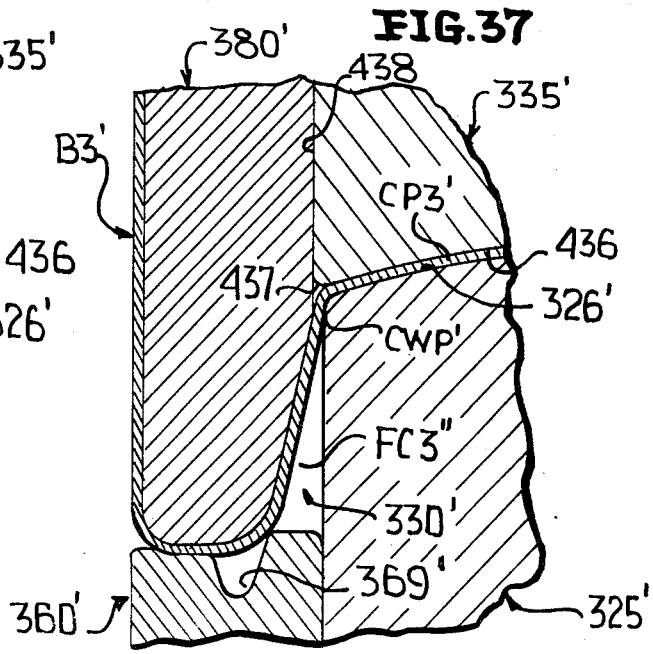
FIG. 37 is a fragmentary schematic cross-sectional view of the tooling of FIG. 36, and illustrates the draw punch at the bottom of its stroke and the frusto-conical wall of FIG. 36 formed into a more angulated frusto-conical wall portion and a cylindrical wall portion.
Figure 38:
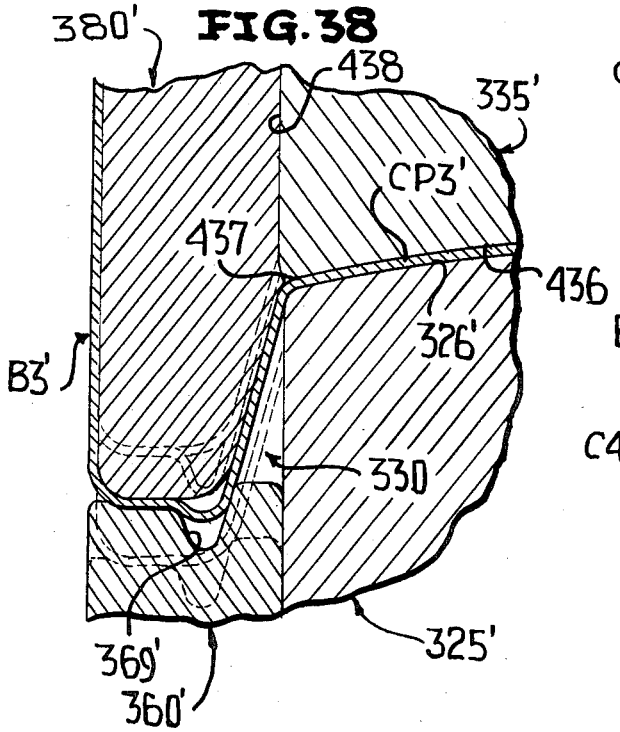
FIG. 38 is a fragmentary schematic cross-sectional view of the tooling of FIG. 37, and illustrates two phantom outline positions and a single solid position of the can bottom or end during upward movement of the draw punch and lift ring at which time the frusto-conical wall portion is progressively formed into an annular stacking bead.
Figure 39:
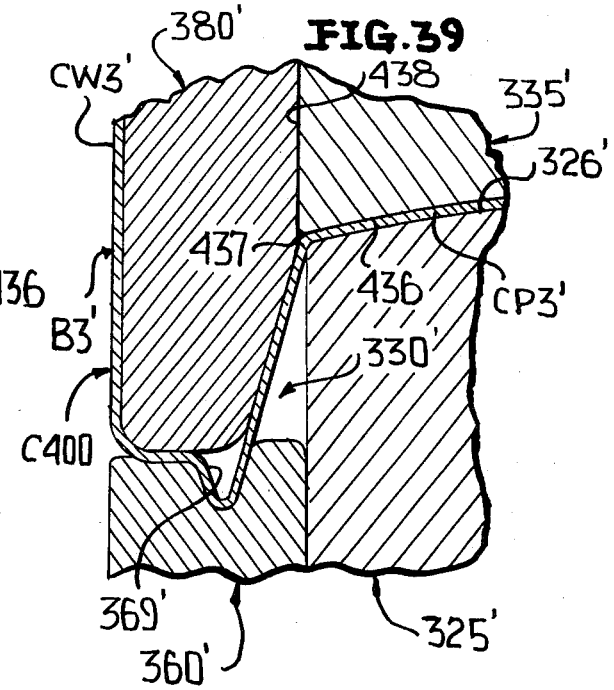
FIG. 39 is a fragmentary schematic cross-sectional view of the tooling of FIG. 38, and illustrates the position of the tooling at which the annular stacking bead has been fully formed.
Figure 40:
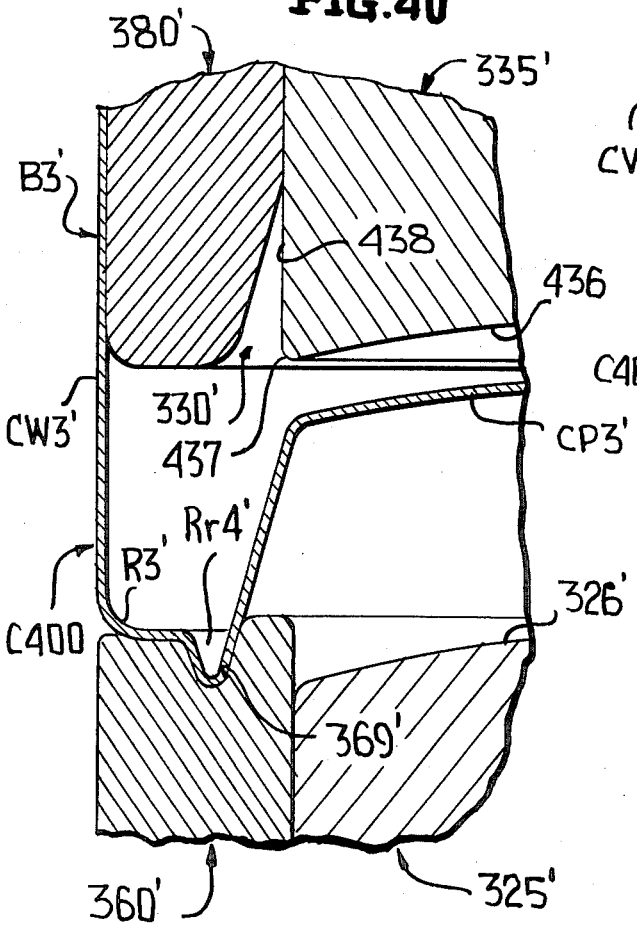
FIG. 40 is a fragmentary schematic cross-sectional view of the tooling of FIG. 39, and illustrates the release of the can bottom by the retraction of the reform pad prior to complete opening of the press of the ejection of the fully formed can.

Subsequently, the reform or return stroke is initiated without any change in the position of the blank punch slide assembly (110 heretofore described) and the cutting punch holder 111 and without in any way reducing the clamping action against the center panel CP3 of the blank B3 between the gripping surfaces 326, 336 (FIGS. 25 through 27). As the spring or springs 93, 95 urge the lift pins heretofore described upwardly against the regulated decrease in the pressures P1 and/or P2 heretofore noted relative to FIG. 8, a progressive upward movement of the lift ring 360 occurs which results in two simultaneous and progressive movements of the metal of the blank B3, namely, the metal of the frusto-conical wall portion FC'' is reformed progressively from the position shown in FIG. 25 toward and into (FIG. 26) the annular channel or chamber 330 forming the reinforcing countersink radius or annular bead Rr3 (FIG. 27), while at the same time the radius R3' is progressively formed into the annular channel 369 of the lift ring 360 forming another reinforcing countersink radius or annular bead Rr4 which in practice is known as a "stacking" bead. In order to effectively receive the metal of the radius R3' into the channel 369, the distance between the surfaces 336 of the draw punch 380 and the surface 365 of the lift ring 360 is such as to readily accommodate and permit the metal in the area of the radius R3' to flow into the channel 369 as the lift ring 360 progressively rises, as is best illustrated by the progressively lowermost phantom outline position shown in FIG. 36, followed by the solid line position in FIG. 26, and eventually the uppermost outline position in FIG. 26 and a final position shown in FIG. 27. Obviously, if desired, the downward force or pressure on the draw punch 380 can be progressively released as the lift ring 360 moves upwardly which assures that the metal of the frusto-conical wall FC3' moves without restraint into not only the channel 369 but also, of course, into the diverging chamber 330.

Upon completion of the return or reforming stroke (FIG. 27), all pressure (P1) on the draw punch shaft (141) FIG. 1) is released, the blank B3 is unclamped, and eventually the punch can be progressively opened (FIG. 28) until the formed can C300 (FIG. 29) can be ejected in a conventional manner. The can C300 is, thus, identical to the can end 150 in all particulars heretofore described, including the graph G but, of course, the can C300 additionally includes the stacking bead Rr4 and the cylindrical wall CW3.

Figure 14:
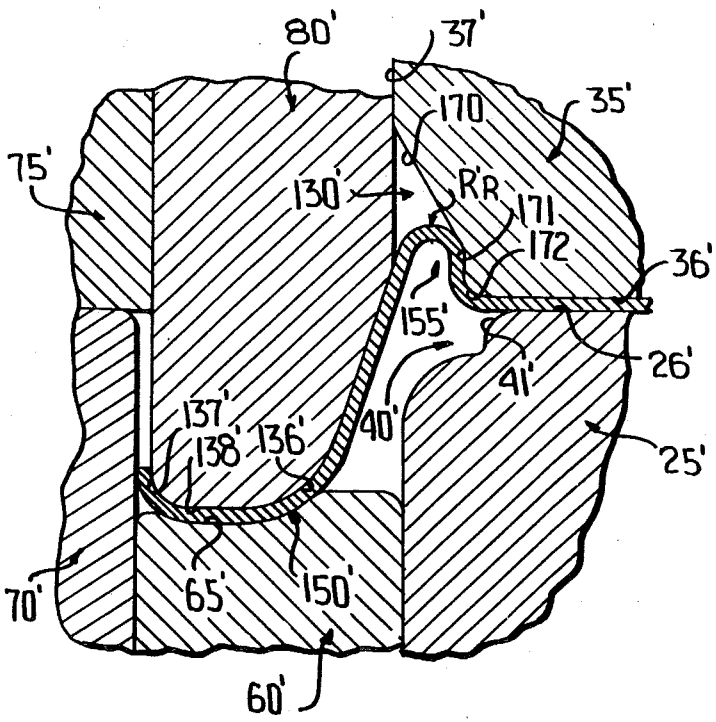
FIG. 14 is an enlarged fragmentary schematic cross-sectional view of the tooling of FIG. 13, and illustrates the manner in which the radius formed by the tooling of FIG. 13 is reformed by the upward movement of the lift ring and draw punch into an annular area set-off in part by the reform pad and angled and cylindrical surfaces.
Figure 13:
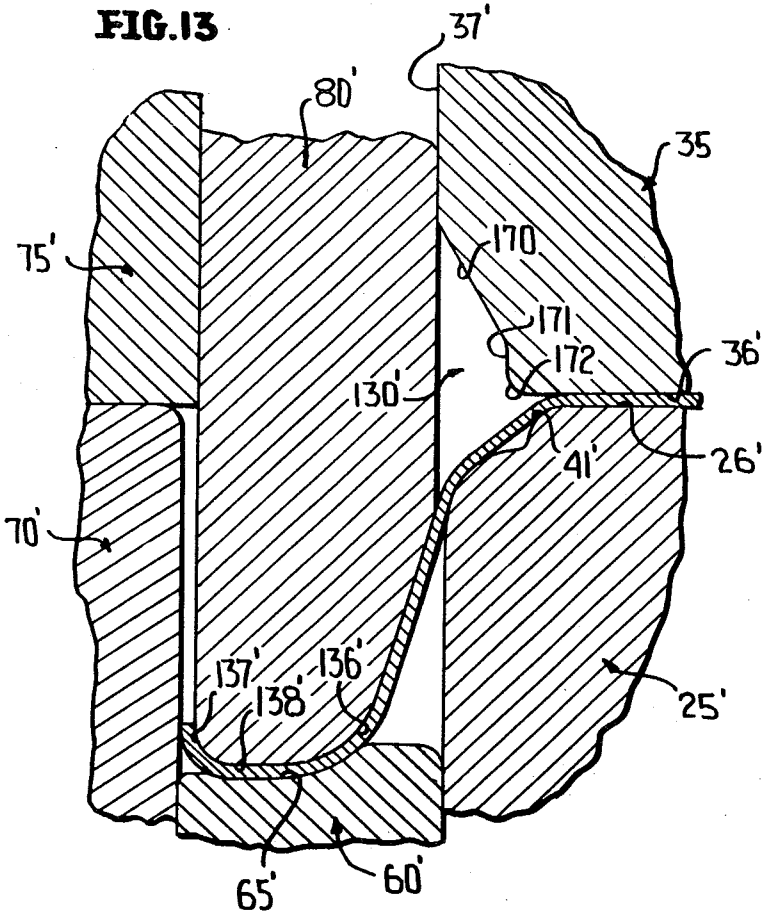
FIG. 13 is an enlarged fragmentary schematic cross-sectional view of a modified form of tooling of the invention at the same position as that illustrated in FIG. 7, and illustrates a modification of the reform pad in which a peripheral surface and a terminal end face are bridged through a radius, a cylindrical surface and an angled surface.
Figure 30:
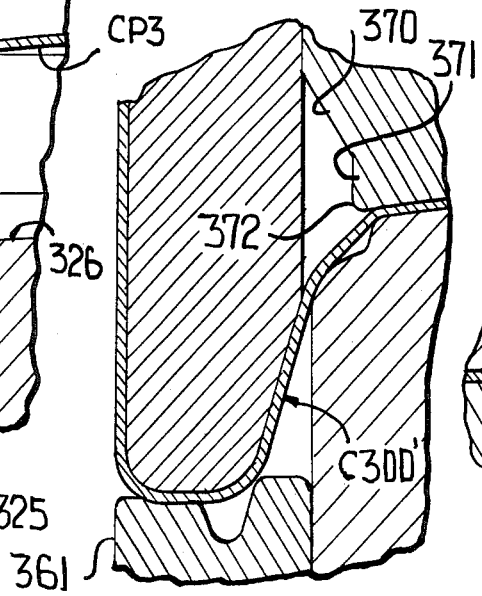
FIG. 30 is a fragmentary schematic cross-sectional view of a modified form of tooling of the invention at the same position as that illustrated in FIG. 25, and illustrates a modification of the reform pad in which a peripheral surface and a terminal end face are bridged through a radius, a cylindrical surface and and angled surface.
Figure 31:
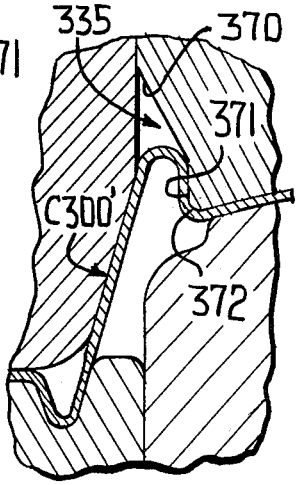
FIG. 31 is a fragmentary schematic cross-sectional view of the tooling of FIG. 30, and illustrates the manner in which frusto-conical wall portions formed by the tooling of FIG. 30 are progressively reformed by the upward movement of the lift ring and draw punch into a reinforcing countersink bead and a stacking bead.
Figure 32:
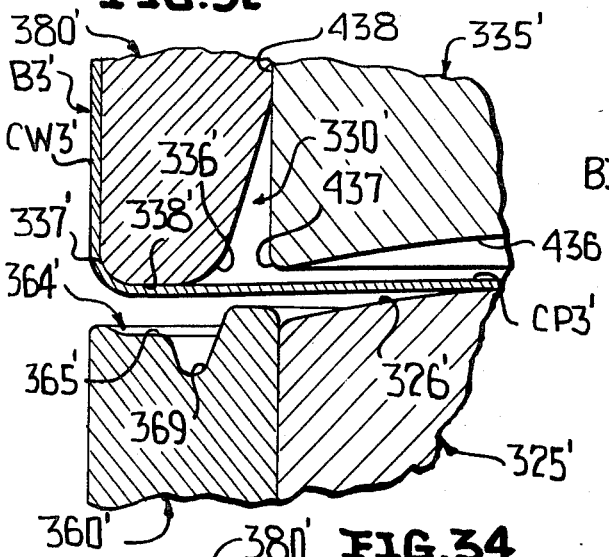
FIG. 32 is a fragmentary schematic axial cross-sectional view of still another draw punch, reform pad, indent ring and lift ring of a punch and die similar to that of FIG. 20, except the same are contoured to form a can body with a stacking bead but without a reinfrocing countersink radius or bead, and illustrates the punch and die parts in association with a cup-shaped blank just as in FIG. 20.
Figure 33:
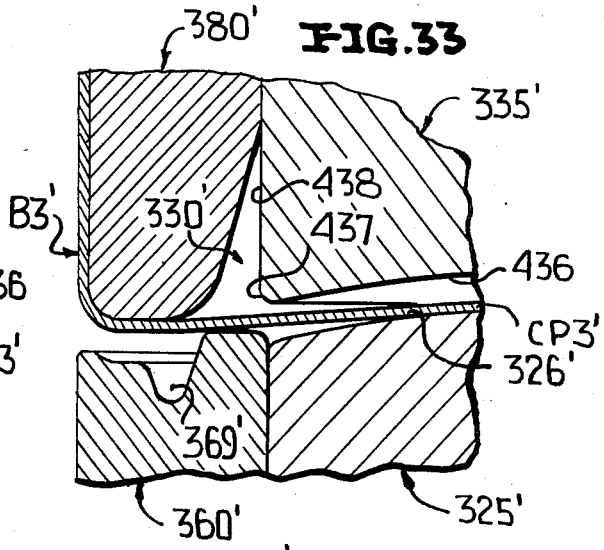
FIG. 33 is a fragmentary schematic cross-sectional view of the tooling of FIG. 32, and illustrates a further sequence in the operation of the press during which the draw punch and reform pad move closer toward the lift ring and indent ring.
Figure 34:
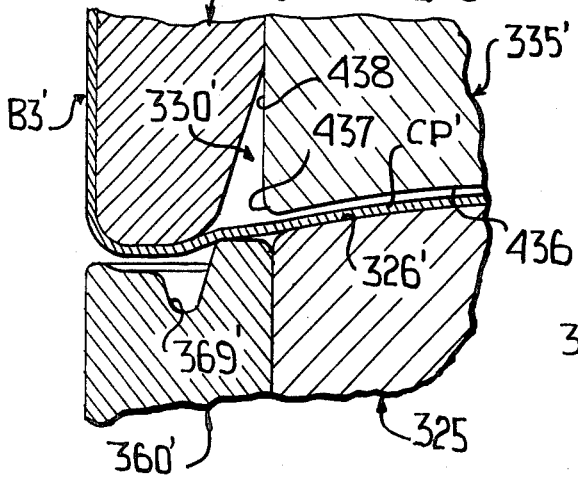
FIG. 34 is a fragmentary cross-sectional view of the tooling of FIG. 33, and illustrates a generally convex axial end face of the draw punch applying downwardly directed forces to a peripheral outboard portion of the cup-shape blank between the body and end panel.
Figure 35:
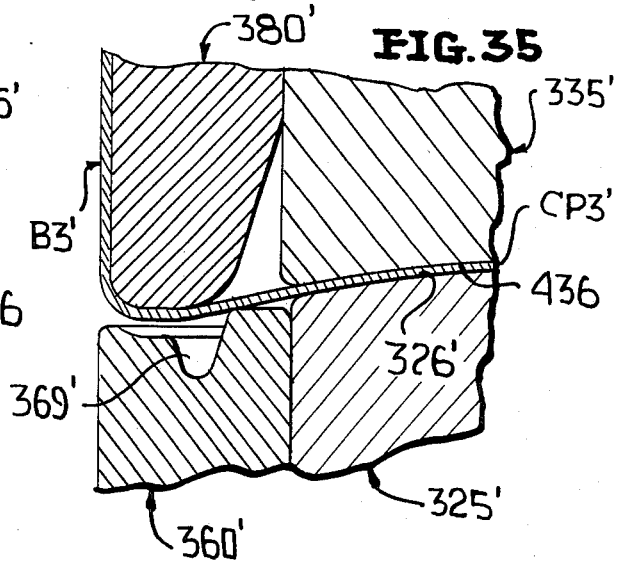
FIG. 35 is a fragmentary schematic cross-sectional view of the tooling of FIG. 34, and illustrates the position at which a central portion of the cup-shaped blank is clamped between axial end faces of the reform pad and the indent ring.

Turning now to FIGS. 30 and 31 of the drawings, it need but be noted that in this case an identical can C300' is formed in the identical manner heretofore described relative to FIGS. 20 through 28, but additionally a reform pad 335' is constructed in accordance with and functions as described relative to FIGS. 13 and 14 particularly relative to the surfaces 370, 371 and 372 thereof.

Reference is now made to FIGS. 32 through 40 of the drawings which structurally correspond to the positions of the parts of the punch and die of FIGS. 20 through 28, respectively. Accordingly, the parts of the punch and die of FIGS. 32 through 40 corresponding generally identically to FIGS. 20 through 28 have been identically numbered although the same have been primed. These parts include an identical draw punch 380', an identical lift ring 360' and an identical indent ring 325'. However, a reform pad 335' differs from the reform pad 335 only in the absence of the tapered or frusto-conical surface, corresponding to the surface 38 of the reform pad 35. In this case the reform pad 335' simply includes a shallow gripping surface 436 opposing the gripping surface 326' of the indent ring 325', a radius 437, and an outer cylindrical surface 438, thus creating a relatively shallow chamber 330'.

Figure 29:
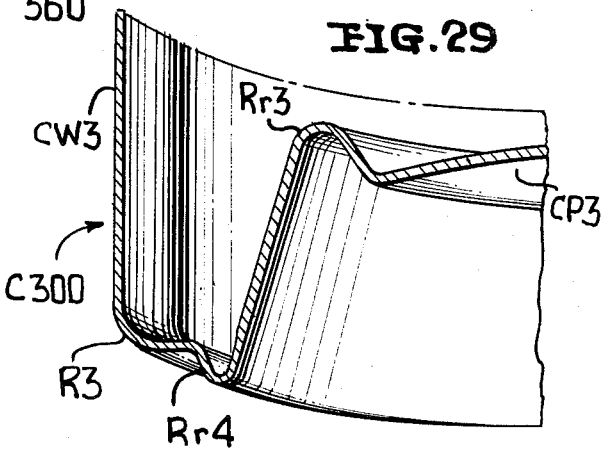
FIG. 29 is a fragmentary cross-sectional view of the can, and illustrates the reinforced pressure-resistant can bottom including the annular inwardly directed reinforcing bead and the annular outwardly directed stacking bead thereof.
Figure 41:
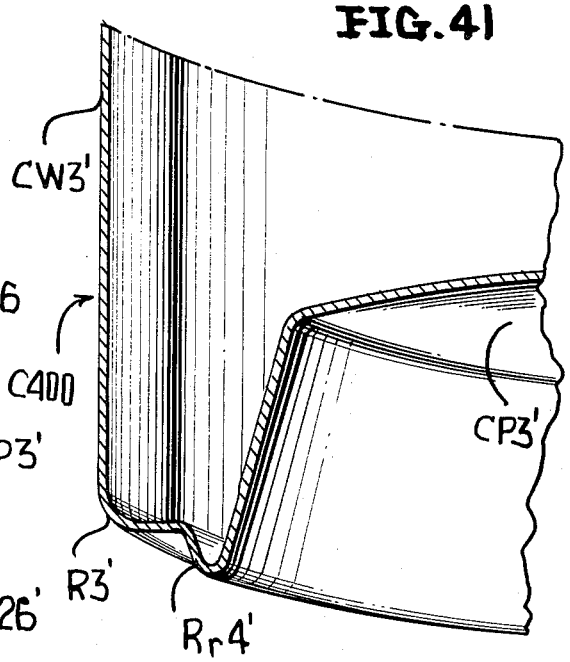
FIG. 41 is a fragmentary cross-sectional view of the totally formed can, and illustrates the bottom including the annular stacking bead thereof.

The draw punch 380', the reform pad 335', the lift ring 360' and the indent ring 325' operate through the positions shown in FIGS. 32 through 40 identically to the operation of the corresponding parts described relative to FIGS. 20 through 28, which description is incorporated hereat by reference, with but one exception. In regard to the latter, reference is made to FIG. 37 of the drawings in which it will be seen that the blank B3' (FIG. 37) excludes the frusto-conical wall portion FC3'' (FIG. 25), and instead includes a generally cylindrical wall portion CWP' which merges with the frusto-conical portion FC3''. Accordingly, as the progressive upward movement of the lift ring 360' begins (lower phantom outline position of FIG. 38), the metal of the frusto-conical wall portion FC3'' is deformed progressively toward and into (FIGS. 38 and 39) the annular channel 369' of the lift ring 360' forming the reinforcing countersink radius or annular bead Rr4' corresponding to the same bead Rr4 of the container C300. However, while the metal freely flows in an unrestrained fashion into the annular channel 369' during the reform stroke, the narrow or shallow channel 330' and the position of the cylindrical wall portion CWP' between the draw punch 380' and the reform pad 335' prevents the metal from entering the channel 330' and precludes the formation of another reinforcing bead corresponding to the bead Rr3 of the container C300. Thereofre, upon the completion of the return or reforming stroke (FIGS. 39 and 40), the eventually formed can C400 (FIG. 41) includes the stacking bead Rr4' but excludes the pressure-resistant bead Rr3 of the container C300 (FIG. 29).

Although in a preferred embodiment of the invention as has been specifically illustrated and described herein, it is to be understood that minor variations may be made in the method without departing from the spirit and scope of the invention, as defined in the appended claims.

We claim:

1. A method of forming a can having a reinforced can bottom comprising the steps of forming a generally cup-shaped blank defined by a generally elongate cylindrical body, a radius portion and an end, exerting first forces against the blank in a first direction to form the end into a concavely outwardly opening end defined by a central end panel, a peripheral wall and an annular inwardly opening channel merging with the cylindrical body, exerting second forces against the annular channel in a second direction opposite the first direction to deform a part of the peripheral wall in the absence of restraint out of the plane of the central end panel toward the interior of the can to form an inwardly projecting outwardly opening annular bead, and the first and second directions defining a single reciprocal opposing path of force exertion by the first and second forces.

2. The method as defined in claim 1 wherein the last-mentioned exerting step creates a wall thickness of at least a portion of the annular bead greater than the wall thickness of the peripheral wall prior to the transformation thereof by the second forces.

3. The method as defined in claim 1 including the step of releasing the gripping of the central end panel only after the completion of the second force exerting step.

4. The method as defined in claim 1 including the step of gripping the annular channel during the performance of the second force.

5. Method of forming a can having a reinforced can bottom comprising the steps of forming a generally cup-shaped blank defined by a generally elongate cylindrical body, a radius portion and an end, exerting first forces against the blank in a first direction to form the end into a concavely outwardly opening end defined by a central end panel, a peripheral wall and an annular inwardly opening channel merging with the cylindrical body, exerting second forces against the annular channel in a second direction opposite the first direction to deform a part of the annular channel out of the plane thereof toward the exterior of the can to form an outwardly projecting inwardly opening annular bead, and the first and second directions defining a single reciprocal opposing path of force exertion by the first and second forces.

6. The method as defined in claim 5 wherein the last-mentioned exerting step creates a wall thickness of at least a portion of the annular bead greater than the wall thickness of the peripheral wall prior to the transformation thereof by the second forces.

7. The method as defined in claim 5 including the step of releasing the gripping of the central end panel only after the completion of the second force exerting step.

8. The method as defined in claim 5 including the step of gripping the annular channel during the performance of the second force.

9. A method of forming a can having a reinforced can bottom comprising the steps of forming a generally cup-shaped blank defined by a generally elongate cylindrical body, a radius portion and an end, exerting first forces against the blank in a first direction to form the end into a concavely outwardly opening end defined by a central end panel, a peripheral wall and an annular inwardly opening channel merging with the cylindrical body, exerting second forces against the annular channel in a second direction opposite the first direction to deform a part of the peripheral wall and a part of the annular channel in opposite axial directions relative to the plane of the central end panel toward and away from the interior of the can to form an inwardly projecting outwardly opening annular bead and an outwardly projecting inwardly opening annular bead, and the first and second directions defining a single reciprocal opposing path of force exertion by the first and second forces.

10. The method as defined in claim 9 wherein the last-mentioned exerting step creates a wall thickness of at least a portion of the inwardly projecting and outwardly projecting annular beads greater than the wall thicknesses of the respective peripheral wall and annular channel prior to the transformation thereof by the second forces.

11. The method as defined in claim 9 including the step of releasing the gripping of the central end panel only after the completion of the second force exerting step.

12. The method as defined in claim 9 including the step of gripping the annular channel during the performance of the second force.

13. A method of forming a one-piece can comprising the steps of applying a first force in a first direction against a blank to form the blank into a cup-shaped blank defined by a generally cylindrical body wall joined by a radius to an end panel, resisting movement of a central panel portion of said end panel to prevent movement of the central panel portion in the first direction while an annular outboard portion thereof is progressively moved in the first direction to transform said end panel of the cup-shaped blank into a recessed end panel defined by the cylindrical body wall, an inboard radius and an annular wall spanning the radius and central panel portion, applying a second force in a second direction opposite the first direction and outboard of the central panel portion while resisting movement of the central panel portion in the second direction to transform at least a portion of the radius into a generally annular stacking bead projecting axially in the first direction.

14. The method as defined in claim 13 wherein the first and second directions define a single reciprocal opposing path of force exertion by the first and second forces.

15. The method as defined in claim 13 wherein the first and second directions define a single reciprocal opposing path of force exertion by the first and second forces, and the portion of the radius formed into the annular stacking bead is maintained generally unrestrained during the transformation thereof.

16. The method as defined in claim 14 wherein another radius merges the annular wall and the central panel portion, and the second force applying step further transforms at least a portion of the another radius into a generally annular bead projecting axial in the second direction.

17. The method as defined in claim 16 wherein the first and second directions define a single reciprocal opposing path of force exertion by the first and second forces.

18. The method as defined in claim 13 wherein the first and second directions define a single reciprocal opposing path of force exertion by the first and second forces, and the portions of the radii formed into the beads are maintained generally unrestrained during the transformation thereof.

* * * * *